US005618660A

United States Patent [19]

Fujiwara et al.

[11] Patent Number: 5,618,660

[45] Date of Patent: Apr. 8, 1997

[54] SILVER HALIDE PHOTOGRAPHIC MATERIAL AND METHOD FOR PROCESSING THE SAME

[75] Inventors: Itsuo Fujiwara; Tadashi Ito, both of Kanagawa, Japan

[73] Assignee: Fuji Photo Film Co., Ltd., Kanagawa, Japan

[21] Appl. No.: 401,295

[22] Filed: Mar. 9, 1995

Related U.S. Application Data

[63] Continuation of Ser. No. 179,228, Jan. 10, 1994, abandoned, which is a continuation of Ser. No. 990,257, Dec. 14, 1992, abandoned.

[30] Foreign Application Priority Data

Dec. 12, 1991 [JP] Japan ..... 3-350667

[51] Int. Cl.[6] ..... G03C 1/035; G03C 1/09; G03C 1/12

[52] U.S. Cl. ..... 430/567; 430/574; 430/584; 430/593; 430/603; 430/605

[58] Field of Search ..... 430/567, 584, 430/593, 603, 605, 944, 574

[56] References Cited

U.S. PATENT DOCUMENTS

| | | | |
|---|---|---|---|
| 4,670,377 | 6/1987 | Miyoshi et al. | 430/584 |
| 5,011,768 | 4/1991 | Ogawa | 430/569 |
| 5,015,561 | 5/1991 | Hayashi et al. | 430/584 |
| 5,112,733 | 5/1992 | Ihama | 430/603 |
| 5,114,838 | 5/1992 | Yamada | 430/603 |
| 5,158,892 | 10/1992 | Sasaki et al. | 430/605 |

FOREIGN PATENT DOCUMENTS

| | | | |
|---|---|---|---|
| 3-198042 | 8/1991 | Japan | 430/603 |
| 1527435 | 10/1978 | United Kingdom . | |

*Primary Examiner*—Janet C. Baxter
*Attorney, Agent, or Firm*—Sughrue, Mion, Zinn, Macpeak & Seas

[57] ABSTRACT

A silver halide photographic material having good spectral-sensitivity to laser rays, and which forms a high-sensitivity and high-contrast image by short-time exposure with high-intensity light. When processed with a reduced amount of replenisher, there is little fluctuation of photographic properties of the processed photographic material. The present invention relates to a silver halide photographic material comprising a support having thereon at least one light-sensitive silver halide emulsion layer comprising a silver halide emulsion containing silver halide grains having a silver chloride content of 50 mol % or less, wherein the silver halide emulsion is spectrally sensitized with a spectral sensitizing dye selected from the group consisting of compounds represented by formulae (I), (II) and (III) and the silver halide emulsion is chemically sensitized with a selenium compound and a gold compound:

where the substituent groups for formulae (I) to (III) are defined in the specification.

10 Claims, No Drawings

SILVER HALIDE PHOTOGRAPHIC MATERIAL AND METHOD FOR PROCESSING THE SAME

This is a continuation of application Ser. No. 08/179,228 filed Jan. 10, 1994 now abandoned, which is a continuation of application Ser. No. 07/990,257 filed Dec. 14, 1992 now abandoned.

FIELD OF THE INVENTION

The present invention relates to a silver halide photographic material, which is well adapted for processing in an automatic developing machine at a high processing rate. The photographic material has a high sensitivity and a high covering power.

BACKGROUND OF THE INVENTION

Recently, a high temperature rapid development processing of silver halide photographic materials has become more widely used, and the processing using an automatic developing machine has been shortened remarkably. In order to attain rapid processing, a photographic material is needed having a high development rate to yield a sufficient blacking density in a short period of time and the ability to be fixed, rinsed and dried in a short period of time. In particular, various methods have heretofore been investigated for attaining rapid drying of processed photographic materials. A method well adapted for improving the driability of processed photographic materials is known in which a sufficient amount of a hardening agent (gelatin crosslinking agent) is previously added to a photographic material in the coating step of preparing the same so as to reduce the swelling rate of the constituent emulsion layer and hydrophilic colloid layer during development, fixation and rinsing. As a result, the water content of the processed photographic material prior to drying is reduced. In accordance with this method, the addition of a larger amount of the hardening agent further reduces the drying time. However, the swelling rate of the constituent layers is lowered to the extent that development of the material is retarded, to thereby reduce sensitivity and contrast or to effectively reduce covering power.

Apart from the above, another rapid processing method is known, for example, as described in JP-A-63-136043 (the term "JP-A" as used herein means an "unexamined published Japanese patent application"), in which a developer and a fixer each having substantially no gelatin-hardening effect are used. This method advantageously promotes the rate of development and the rate of fixation using the processing solutions having substantially no gelatin hardening effect, while the rate of drying is reduced. Therefore, this method is not considered to be sufficiently effective.

On the other hand, as a method of promoting the rate of development and enhancing covering power, the addition of various additives to silver halides is known. Such additives include, for example, the polyacrylamide polymer additives as disclosed in U.S. Pat. Nos. 3,271,158 and 3,514,289; and dextran compounds such as saccharide additives as disclosed in U.S. Pat. Nos. 3,063,838 and 3,272,631. However, where these compounds are added to photographic materials in an amount sufficient to satisfy the above objects, the driability of the materials and the film strength thereof are deteriorated.

In addition, other methods are known for elevating the developing activity of a developer, in which the amount of the developing agent and that of the developing aid in the developer are increased, the pH value of the developer is elevated, and the developer processing temperature is elevated. However, all of these methods have various drawbacks in that the preservability of the developer is reduced, the contrast of the processed material is lowered or softened even though the sensitivity thereof is elevated, and the processed material is readily fogged.

Apart from rapid processability, further elevation of the sensitivity and covering power of photographic materials is an objective heretofore sought in this technical field. Where an increase in sensitivity of photographic materials is realized by enlarging the grain size of silver halide grains therein, the covering power of the grains is generally lowered. Therefore, if increased sensitivity of photographic materials could not be attained by using silver halide grains having the same grain size, or if increased covering power thereof could not be attained by using silver halide grains of the same sensitivity, then such would not constitute a significant advance in the art.

SUMMARY OF THE INVENTION

An object of the present invention is to provide a silver halide photographic material containing silver halide grains of an ordinary grain size (as the diameter of projected area), yet having excellent developability and sensitivity and having a high covering power, especially when exposed by means of a scanning laser exposure. Another object of the present invention is to provide a silver halide photographic material having good photographic sensitivity to He-Ne laser light and semiconductor laser light, in which there is little fluctuation of photographic properties when processed with a reduced amount of replenisher. In a method of rapidly processing the photographic material, the processing loads in the fixation, rinsing and drying steps are reduced.

The above object of the present invention has been attained by providing a silver halide photographic material comprising a support having thereon at least one light-sensitive silver halide emulsion layer comprising a silver halide emulsion containing silver halide grains having a silver chloride content of 50 mol % or less, wherein the silver halide emulsion is spectrally sensitized with a spectral sensitizing dye selected from the group consisting of compounds represented by formulae (I), (II) and (III) and the silver halide emulsion is chemically sensitized with a selenium compound and a gold compound:

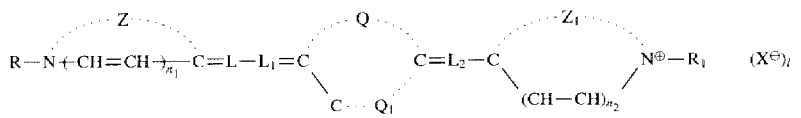

(I)

where Z and $Z_1$ each represents a non-metallic atomic group necessary for completing a 5-membered or 6-membered nitrogen-containing heterocyclic nucleus;

R and $R_1$ each represents an alkyl group, a substituted alkyl group, or an aryl group;

Q and $Q_1$ together represent a non-metallic atomic group necessary for completing a 4-thiazolidinone, 5-thiazolidinone or 4-imidazolidinone nucleus;

L, $L_1$ and $L_2$ each represents a methine group or a substituted methine group;

$n_1$ and $n_2$ each represent 0 or 1;

X represents an anion; and

ι represents 0 or 1, and when the compound forms an internal salt, then ι is 0:

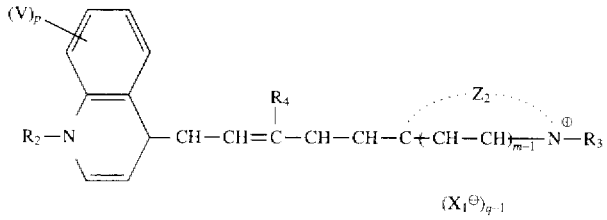

where $R_2$ and $R_3$ may be same as or different from each other and each represents an alkyl group;

$R_4$ represents a hydrogen atom, a lower alkyl group, a lower alkoxy group, a phenyl group, a benzyl group or a phenethyl group;

V represents a hydrogen atom, a lower alkyl group, an alkoxy group, a halogen atom or a substituted alkyl group;

$Z_2$ represents a non-metallic atomic group necessary for completing a 5-membered or 6-membered nitrogen-containing hetero ring;

$X_1$ represents an acid anion; and m, p and q independently represent 1 or 2, provided that when the compound forms an internal salt, then q is 1:

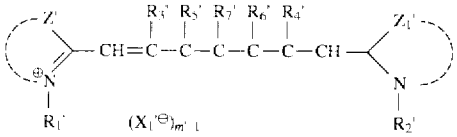

(III)

where $R_1'$ and $R_2'$ may be same as or different from each other and each represents an alkyl group;

$R_3'$ and $R_4'$ independently represent a hydrogen atom, a lower alkyl group, a lower alkoxy group, a phenyl group, a benzyl group or a phenethyl group;

$R_5'$ and $R_6'$ each represent a hydrogen atom, or $R_5'$ and $R_6'$ are bonded to each other to form a divalent alkylene group;

$R_7'$ represents a hydrogen atom, a lower alkyl group, a lower alkoxy group, a phenyl group, a benzyl group, or —$NW_1'(W_2')$ in which $W_1'$ and $W_2'$ independently represent an alkyl group or an aryl group or $W_1'$ and $W_2'$ may be bonded to each other to form a 5-membered or 6-membered nitrogen-containing hetero ring;

$R_3'$ and $R_7'$, or $R_4'$ and $R_7'$ may be bonded to each other to form a divalent alkylene group;

Z' and $Z_1'$ independently represent a non-metallic atomic group necessary for forming a 5-membered or 6-membered nitrogen-containing hetero ring;

$X_1'$ represents an acid anion; and m' represents 1 or 2, provided that when the dye forms an internal salt, then m' is 1.

In a preferred embodiment of the present invention, a method is provided, for processing in an automatic developing machine a silver halide photographic material comprising a support having thereon at least one light-sensitive silver halide emulsion layer comprising a silver halide emulsion containing silver halide grains having a silver chloride content of 50 mol % or less, wherein the silver halide emulsion is spectrally sensitized with a spectral sensitizing dye selected from the group consisting of compounds represented by the preceding formulae (I), (II) and (III) and the silver halide emulsion is chemically sensitized with a selenium compound and a gold compound, comprising the steps of developing in a developer containing a 3-pyrazolidone developing agent represented by formula (IV):

(II)

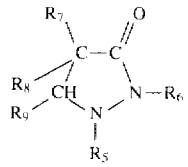

(IV)

where $R_5$ represents an aryl group; and $R_6$, $R_7$, $R_8$ and $R_9$ may be same as or different from one another and each represents a hydrogen atom, an alkyl group, an aryl group or an aralkyl group, provided that when $R_5$ is an unsubstituted phenyl group, then all of $R_6$, $R_7$, $R_8$ and $R_9$ are not hydrogen atoms at the same time.

DETAILED DESCRIPTION OF THE INVENTION

The present invention is described in detail below.

The silver halide emulsion constituting the light-sensitive silver halide emulsion layer of the photographic material of the present invention may be any of silver bromide, silver chlorobromide or silver iodochlorobromide having a silver chloride content of 50 mol % or less. Preferred is a silver chlorobromide having a silver chloride content of 50 mol % or less, more preferably 5 to 30 mol %.

The silver halide grains in the emulsion are preferably fine grains, for example, having a mean grain size of 0.7 μm or less, especially preferably 0.1 to 0.5 μm.

The shape of the silver halide grains constituting the emulsion may be any of cubic, octahedral, tetradecahedral, tabular or spherical. The grains may also be a mixture of these shapes. Preferred are cubic, tetradecahedral or tabular grains.

The photographic emulsion constituting the photographic material of the present invention may be prepared by known methods, for example, as described in P. Glafkides, *Chimie et Physique Photographique* (published by Paul Montel Co., 1967), G. F. Duffin, *Photographic Emulsion Chemistry* (published by The Focal Press Co., 1966) or V. L. Zelikman et al, *Making and Coating Photographic Emulsion* (published by The Focal Press Co., 1964).

Briefly, the emulsion may be prepared by any of the acid method, neutral method and ammonia method. For forming the emulsion by reacting a soluble silver salt and soluble halide(s), any of a single jet method, double jet method and combination of these methods may be employed.

A reverse mixing method may also be employed, in which the grains are formed in the presence of excess silver ion. As one example of the double jet method, a controlled double jet method may be employed in the present invention in which the pAg value in the liquid phase of the system forming the silver halide grains is kept constant. According to this method, a silver halide emulsion having a regular crystal form and having a nearly uniform grain size distribution may be obtained.

In order to obtain a uniform grain size of the silver halide grains constituting the photographic material of the present invention, preferably employed are a method of varying the addition speed of silver nitrate and alkali halides in accordance with the growth speed of the grains being formed, as described in British Patent 1,535,016 and JP-B-48-36890 and JP-B-52-16364 (the term "JP-B" as used herein means an "examined Japanese patent publication"), and a method of varying the concentrations of the aqueous solutions of the reactants, as described in British Patent 4,242,445 and JP-A-55-158124. In these methods, the grains are grown rapidly within a range not exceeding the critical saturation degree thereof.

The silver halide grains of the emulsion of the present invention may have a core/shell structure in which the inside (core) and the surface (shell) of each grain have different halogen compositions.

Formation of the grains of the silver halide emulsion of the present invention is preferably effected in the presence of a silver halide solvent such as a tetra-substituted thiourea or an organic thioether compound.

Preferred tetra-substituted thioureas as a silver halide solvent are, for example, described in JP-A-53-82408 and JP-A-55-77737.

Preferred organic thioethers as a silver halide solvent are, for example, compounds containing at least one group where the oxygen atom and the sulfur atom are separated from each other via ethylene (e.g., —O—$C_2H_5$—S—) as described in JP-B-47-11386 (U.S. Pat. No. 3,574,628); and chained thioether compounds having alkyl groups at both terminals (in which the alkyl groups each have at least two substituents selected from hydroxyl, amino, carboxyl, amido and sulfone groups) as described in JP-A-54-155828 (U.S. Pat. No. 4,276,374).

The amount of the silver halide solvent to be added in formation of the grains varies, depending upon the kind of the compound used, the grain size and halogen composition of the grains to be formed. Preferably, the silver halide solvent content is from $1\times10^{-5}$ to $1\times10^{-2}$ mol per mol of silver halide.

If the grain size of the silver halide grains to be formed is greater than the intended range due to addition of the silver halide solvent, the temperature of the reaction system and the time for addition of the silver salt solution and the halide solution may be varied to attain the desired grain size.

The selenium sensitizing agent for use in the present invention may be a selenium compound illustrated in known patent publications, and is not particularly limited. In general, unstable selenium compounds and/or stable selenium compounds may be added to sensitize the emulsion, e.g., by stirring at a high temperature, preferably at 40° C. or higher, for a predetermined period of time. Preferred unstable selenium compounds include those described in JP-B-44-15748 and JP-B-43-13489 and JP-A-4-25832 and JP-A-4-109240. Specific examples of useful unstable selenium sensitizing agents include isoselenocyanates (e.g., aliphatic isoselenocyanates such as allyl isoselenocyanate), selenoureas, selenoketones, selenoamides, selenocarboxylic acids (e.g., 2-selenopropionic acid, 2-selenoacetic acid), selenoesters, diacylselenides (e.g., bis(3-chloro-2,6-dimethoxybenzoyl) selenide), selenophosphates, phosphine selenides, and colloidal metal selenium.

The preferred examples of unstable selenium compounds for use in the present invention noted above are not limiting. The chemical structure of unstable selenium compounds as a sensitizer for a photographic emulsion is not particularly limited, provided that the selenium contained therein is unstable. It is generally understood that the role of the organic moiety in the selenium sensitizer molecule is to carry selenium therewith so as to incorporate the selenium in an emulsion in an unstable form. Therefore, generally any known unstable selenium compound is advantageously used in the present invention.

Stable selenium compounds for use in the present invention include the compounds described in JP-B-46-4553, JP-B-52-34492 and JP-B-52-34491. Specific examples of useful stable selenium compounds (i.e., non-unstable selenium compounds) include selenous acid, potassium selenocyanide, selenazoles, quaternary salts of selenazoles, diaryl selenides, diaryl diselenides, dialkyl selenides, dialkyl diselenides, 2-selenazolidine-dione, 2-selenoxazolidine-thione and their derivatives.

Of these selenium compounds, preferred are those represented by formulae (V) and (VI):

$$Z_3-\overset{\overset{\displaystyle Se}{\|}}{C}=Z_4 \qquad (V)$$

In formula (V), $Z_3$ and $Z_4$ may be same as or different from each other and each represents an alkyl group (e.g., methyl, ethyl, t-butyl, adamantyl, t-octyl), an alkenyl group (e.g., vinyl, propenyl), an aralkyl group (e.g., benzyl, phenethyl), an aryl group (e.g., phenyl, pentafluorophenyl, 4-chlorophenyl, 3-nitrophenyl, 4-octylsulfamoylphenyl, α-naphthyl), a heterocyclic group (e.g., pyridyl, thienyl, furyl, imidazolyl), —$NR_{10}(R_{11})$, —$OR_{12}$ or —$SR_{13}$.

$R_{10}$, $R_{11}$, $R_{12}$ and $R_{13}$ may be same as or different from each other and each represents an alkyl group, an aralkyl group, an aryl group or a heterocyclic group. Examples of the alkyl, aralkyl, aryl and heterocyclic groups are the same as those given for $Z_3$ above.

$R_{10}$ and $R_{11}$ each may also be a hydrogen atom or an acyl group (e.g., acetyl, propanoyl, benzoyl, heptafluorobutanoyl, difluoroacetyl, 4-nitrobenzoyl, α-naphthoyl, 4-trifluoromethylbenzoyl).

In formula (V), $Z_3$ is preferably an alkyl group, an aryl group or —$NR_{10}(R_{11})$, and $Z_4$ is preferably —$NR_{14}(R_{15})$, in which $R_{10}$, $R_{11}$, $R_{14}$ and $R_{15}$ may be same as or different from each other and each represents a hydrogen atom, an alkyl group, an aryl group or an acyl group.

Preferred compounds of formula (V) are N,N-dialkylselenoureas, N,N,N'-trialkyl-N'-acylselenoureas, tetraalkylselenoureas, N,N-dialkylarylselenoamides, and N-alkyl-N-aryl-arylselenoamides.

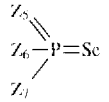

$$Z_5,\ Z_6,\ Z_7-P=Se \qquad (VI)$$

In formula (VI), $Z_5$, $Z_6$ and $Z_7$ are same as or different from each other and each represents an aliphatic group, an aromatic group, a heterocyclic group, —$OR_{16}$, —$NR_{17}(R_{18})$, —$SR_{19}$, —$SeR_{20}$, $X_2$ or a hydrogen atom.

$R_{14}$, $R_{19}$ and $R_{20}$ each represent an aliphatic group, an aromatic group, a heterocyclic group, a hydrogen atom or a cation; $R_{17}$ and $R_{18}$ each represent an aliphatic group, an aromatic group, a heterocyclic group or a hydrogen atom; and $X_2$ represents a halogen atom.

In formula (VI), the aliphatic group for $Z_5$, $Z_6$, $Z_7$, $R_{16}$, $R_{17}$, $R_{18}$, $R_{19}$ and $R_{20}$ is a linear, branched or cyclic alkyl, alkenyl, alkynyl or aralkyl group (e.g., methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentynyl, benzyl, phenethyl).

In formula (VI), the aromatic group for $Z_5$, $Z_6$, $Z_7$, $R_{16}$, $R_{17}$, $R_{18}$, $R_{19}$ and $R_{20}$ is a monocyclic or condensed aryl group (e.g., phenyl, pentafluorophenyl, 4-chlorophenyl, 3-fluorophenyl, α-naphthyl, 4-mehtylphenyl).

In formula (VI), the heterocyclic group for $Z_5$, $Z_6$, $Z_7$, $R_{16}$, $R_{17}$, $R_{18}$, $R_{19}$ and $R_{20}$ is a 3-membered to 10-membered saturated or unsaturated heterocyclic group containing at least one hetero atom selected from nitrogen, oxygen and sulfur atom (e.g., pyridyl, thienyl, furyl, thiazolyl, imidazolyl, benzimidazolyl).

In formula (VI), the cation for $R_{16}$, $R_{19}$ and $R_{20}$ is an alkali metal atom or an ammonium group. X represents a halogen atom, for example, a fluorine, chlorine, bromine or iodine atom.

In formula (VI), $Z_5$, $Z_6$, and $Z_7$ each are preferably an aliphatic group, an aromatic group or —$OR_{16}$, in which $R_{16}$ is an aliphatic group or an aromatic group.

Compounds of formula (VI) are more preferably trialkylphosphine selenides, triarylphosphine selenides, trialkyl selenophosphates and triaryl selenophosphates.

Specific examples of the compounds of formulae (V) and (VI) are given below, however, the present invention should not be construed as being limited thereto.

1.

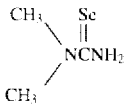

2.

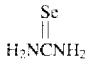

3.

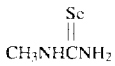

4.

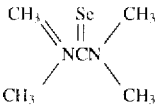

5.

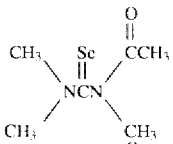

6.

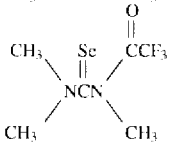

-continued

7.

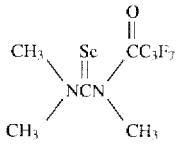

8.

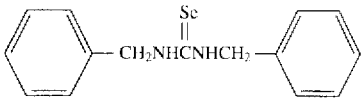

9.

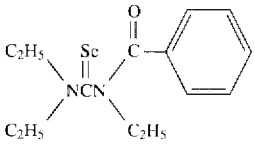

10.

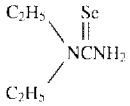

11.

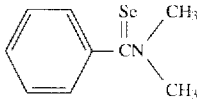

12.

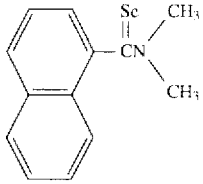

13.

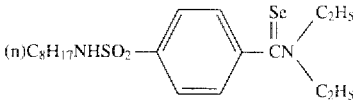

14.

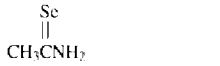

15.

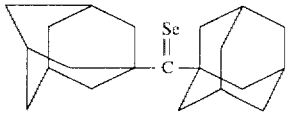

16.

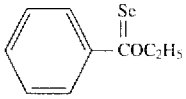

17.

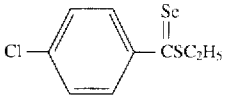

18.

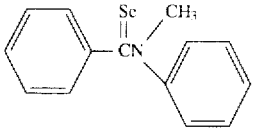

-continued

19.

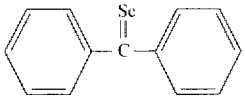

20.

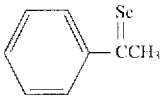

21.

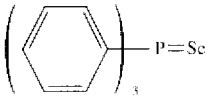

22.

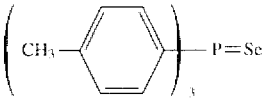

23.

$(nC_4H_9)_3P{=}Se$

24.

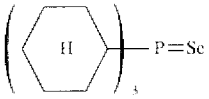

25.

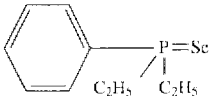

26.

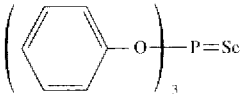

27.

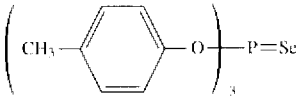

28.

$(nC_4H_9O)_3P{=}Se$

29.

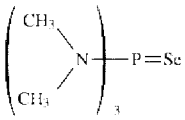

30.

$(C_2H_5O)_3P{=}Se$

31.

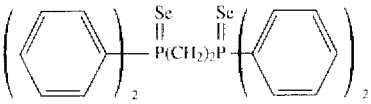

32.

$(nC_8H_{17})_3P{=}Se$

33.

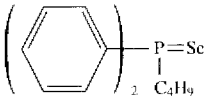

34.

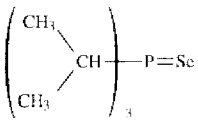

-continued

35.

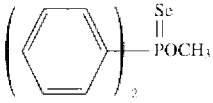

36.

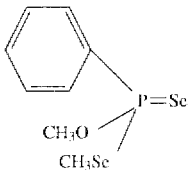

37.

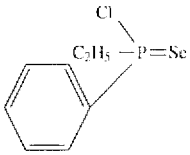

38.

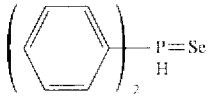

39.

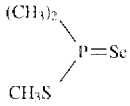

Selenium sensitization for use in the present invention and a method for preparing the stable or unstable selenium compound as a selenium sensitizing agent are described in, for example, U.S. Pat. Nos. 1,574,944, 1,602,592, 1,623,499, 3,297,446, 3,297,447, 3,320,069, 3,408,196, 3,408,197, 3,442,653, 3,420,670, 3,591,385, French Patents 2,693,038, 2,093,209, JP-B-52-34491, JP-B-52-34492, JP-B-53-295, JP-B-57-22090, JP-A-59-180536, JP-A-59-185330, JP-A-59-181337, JP-A-59-187338, JP-A-59-192241, JP-A-60-150046, JP-A-60-151637, JP-A-61-246738, JP-A-3-4221, JP-A-3-148648, JP-A-3-111838, JP-A-3-116132, JP-A-3-237450, JP-A-4-25832, JP-A-4-32831, JP-A-4-109240, Japanese Patent Application No. 2-110558 (corresponding to U.S. patent application Ser. No. 692,356), British Patents 255,846, 861,984, and H. E. Spencer et al, *Journal of Photographic Science,* Vol. 31, pp. 158–168 (1983).

The selenium sensitizing agent is added to the emulsion to be sensitized therewith during chemical sensitization of the emulsion, in the form of a solution in a single solvent of water, methanol, ethanol or the like organic solvent or in a mixed solvent thereof, or in the form as described in JP-A-4-140738 and JP-A-4-140739. Preferably, the selenium sensitizing agent is added to the emulsion before initiation of chemical sensitization of the emulsion. In the present invention, two or more kinds of selenium sensitizers may be used in combination. A combination of unstable selenium compounds and stable selenium compounds may also be employed.

The addition amount of the selenium sensitizing agent for chemical sensitization of the emulsion of the present invention varies, depending upon the activity of the agent used, the kind and size of silver halides to be sensitized therewith, and the temperature and time for ripening. Preferably, the addition amount of the selenium sensitizing agent is $1\times10^{-8}$ mol or more, more preferably from $1\times10^{-7}$ mol to $1\times10^{-5}$ mol, per mol of the silver halide. The temperature for chemical ripening with the selenium sensitizing agent is preferably 45° C. or higher, more preferably from 50° C. to 80° C. The pAg and pH value of the system for the chemical sensitization is not particularly limited. For instance, the pH value may have a broad range of from 4 to 9 to attain the effect of the present invention.

The selenium sensitization is more effectively carried out in the presence of a silver halide solvent.

The silver halide photographic emulsion of the present invention is chemically sensitized by selenium sensitization and gold sensitization (preferably selenium sensitization and sulfur sensitization and gold sensitization), to thereby further elevate sensitivity with little fogging.

Sulfur sensitization of the emulsion may be effected generally by adding thereto a sulfur sensitizing agent followed by stirring the emulsion at a high temperature, preferably at 40° C. or higher (more preferably 40° to 80° C. and most preferably 40° to 70° C.), for a predetermined period of time.

Gold sensitization of the emulsion may also be effected generally by adding thereto a gold sensitizing agent followed by stirring the emulsion at a high temperature, preferably at 40° C. or higher (more preferably 40° to 80° C. and most preferably 40° to 70° C.), for a predetermined period of time.

For the sulfur sensitization, any known sulfur sensitizing agent may be used. For example, useful sulfur sensitizing agents include thiosulfates, thioureas, allyl isothiacyanate, cystine, p-toluene thiosulfonate and rhodanine. In addition, the sulfur sensitizing agents described in U.S. Pat. Nos. 1,574,844, 2,410,689, 2,278,947, 2,728,668, 3,501,313, 3,656,855, German Patent 1,422,869, JP-B-56-24937, and JP-A-55-45016 may be used. The amount of the sulfur sensitizing agent added to the emulsion is that amount sufficient to effectively augment the sensitivity of the emulsion. The addition amount varies in a broad range under various conditions of the pH value and temperature of the system and the size of silver halide grains in the emulsion. The addition amount of the sulfur sensitizing agent is preferably from $1\times10^{-7}$ mol to $5\times10^{-4}$ mol, more preferably from $1\times10^{-6}$ to $1\times10^{-4}$ mol, per mol of silver halide.

The gold sensitizing agent for gold sensitization for use in the present invention has a gold oxidation number of from +1 or +3. Any gold compound generally used as a sensitizing agent may be used. Specific examples of the gold sensitizing agent include chloroaurates, potassium chloroaurate, and auric trichloride, potassium auric thiocyanate, potassium iodoaurate, tetracyanoauric acid, ammonium aurothiocyanate and pyridyl trichlorogold.

The addition amount of the gold sensitizing agent varies, depending upon various conditions. In general, the addition amount of the gold sensitizing agent is preferably from $1\times10^{-7}$ mol to $5\times10^{-4}$ mol, more preferably from $5\times10^{-7}$ to $1\times10^{-4}$ mol, per mol of the silver halide.

The time and order of adding to a silver halide emulsion of the present invention a selenium sensitizing agent and a gold sensitizing agent, etc., for chemical ripening of the emulsion are not particularly limited. For example, the above-noted sensitizing agents may be added to the emulsion during chemical ripening, all at once or separately in any desired order. The sensitizing agents may be previously dissolved in water or in a water-miscible organic solvent such as methanol, ethanol or acetone or in a mixed solvent of the same, and the resulting solution may be added to the emulsion.

The amount of silver in the silver halide emulsion coated is 2.8 g/m$^2$ or less based on one surface side of the support. Further the total amount of gelatin coated on the same surface side of the support as that coated with the silver halide emulsion is preferably 4.0 g/m$^2$ or less and particularly preferably 3.5 g/m$^2$ or less.

Spectral sensitizing dyes preferably applied to the silver halide emulsion of the present invention have an optimum spectral-sensitivity to the light wavelength of He-Ne lasers and semiconductor lasers and are represented by the preceding formulae (I), (II) and (III). However, where the spectral sensitizing dyes are used singly, the spectral-sensitizing efficiency thereof is not sufficient. If the addition amount of the spectral sensitizing dye is increased, the intrinsic desensitization tends to increase. However, where the spectral sensitizing dyes are combined with the emulsion of the present invention, the spectral sensitizing efficiency thereof further increases. As a result, the sensitivity of the emulsion thus spectral-sensitized is much greater than the sensitivity of an emulsion sensitized with conventional spectral-sensitizers. The effect is surprising, and is beyond the expectation of those skilled in the art.

Sensitizing dyes of formulae (I), (II) and (III) of the present invention are explained in detail below.

In formula (I), the nitrogen-containing heterocyclic nucleus completed by Z or $Z_1$ includes, for example, thiazole nuclei (e.g., thiazole, 4-methylthiazole, 4-phenylthiazole, 4,5-dimethylthiazole, 4,5-diphenylthiazole), benzothiazole nuclei (e.g., benzothiazole, 5-chlorobenzothiazole, 6-chlorobenzothiazole, 5-mehtylbenzothiazole, 6-methylbenzothiazole, 5-bromobenzothiazole, 6-bromobenzothiazole, 5-iodobenzothiazole, 6-iodobenzothiazole, 5-phenylbenzothiazole, 5-methoxybenzothiazole, 6-mehtoxybenzothiazole, 5-ethoxybenzothiazole, 5-ethoxycarbonylbenzothiazole, 5-hydroxybenzothiazole, 5-carboxybenzothiazole, 5-fluorobenzothiazole, 5-dimethylaminobenzothiazole, 5-acetylaminobenzothiaozle, 5-trifluoromethylbenzothiazole, 5,6-dimethylbenzothiazole, 5-hydroxy-6-methylbenzothiazole, 5-ethoxy-6-methylbenzothiazole, tetrahydrobenzothiazole), naphthothiazole nuclei (e.g., [2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole), selenazole nuclei (e.g., 4-methylselenazole, 4-phenylselenazole), benzoselenazole nuclei (e.g., benzoselenazole, 5-chlorobenzoselenazole, 5-phenylbenzoselenazole, 5-methoxybenzoselenazole, 5-methylbenzoselenazole, 5-hydroxybenzoselenazole), naphthoselenazoles (e.g., naphtho[2,1-d]selenazole, naphtho[1,2-d]selenazole), oxazole nuclei (e.g., oxazole, 4-methyloxazole, 5-methyloxazole, 4,5-dimethyloxazole), benzoxazole nuclei (e.g., benzoxazole, 5-fluorobenzoxazole, 5-chlorobenzoxazole, 5-bromobenzoxazole, 5-trifluoromethylbenzoxazole, 5-methylbenzoxazole, 5-methyl-6-phenylbenzoxazole, 5,6-dimethylbenzoxazole, 5-methoxybenzoxazole, 5,6-dimethoxybenzoxazole, 5-phenylbenzoxazole, 5-carboxybenzoxazole, 5-methoxycarbonylbenzoxazole, 5-acetylbenzoxaozle, 5-hydroxybenzoxazole), naphthoxazole nuclei (e.g., naphtho[2,1-d]oxazole, naphtho[1,2-d]oxazole, naphtho[2,3-d]oxazole), 2-quinoline nuclei, imidazole nuclei, benzimidazole nuclei, 3,3'-dialkylindolenine nuclei, 2-pyridine nuclei, and thiazoline nuclei. Especially preferably, at least one of Z and $Z_1$ is selected from thiazole nuclei, thiazoline nuclei, oxazole nuclei and benzoxazole nuclei.

In formula (I) the alkyl group represented by R and $R_1$ preferably one has 1 to 5 carbon atoms, such as methyl, ethyl, n-propyl or n-butyl group; the substituted alkyl group represented by R and $R_1$ is preferably one in which the alkyl radical has 5 or less carbon atoms, such as a hydroxyalkyl group (e.g., 2-hydroxyethyl, 3-hydroxypropyl, 4-hydropxybutyl), a carboxyalkyl group (e.g., carboxymethyl, 2-carboxyethyl, 3-carboxypropyl, 4-carboxybutyl, 2-(2-carboxyethoxy)ethyl), a sulfoalkyl group (e.g., 2-sulfoethyl, 3-sulfopropyl, 3-sulfobutyl, 4-sulfobutyl, 2-hydroxy-3-sulfopropyl, 2-(3-sulfopropoxy)ethyl, 2-acetoxy-3-sulfopropyl, 3-methoxy-2-(3-sulfopropoxy)propyl, 2-[(3-sulfopropoxy)-ethoxy]ethyl, 2-hydroxy-3-(3'-sulfopropoxy)propyl), an aralkyl group (in which the alkyl radical preferably has from 1 to 5 carbon atoms, and the aryl radical is preferably a phenyl group such as benzyl, phenethyl, phenylpropyl, phenylbutyl, p-tolylpropyl, p-methoxyphenethyl, p-chlorophenethyl, p-carboxybenzyl, p-sulfophenethyl, p-sulfobenzyl), an aryloxyalkyl group (in which the alkyl radical preferably has from 1 to 5 carbon atoms, and the aryl radical in the aryloxy moiety is preferably a phenyl group such as phenoxyethyl, phenoxypropyl, phenoxybutyl, p-methylphenoxyethyl, p-methoxyphenoxypropyl), or a vinylmethyl group; and the aryl group represented by R and $R_1$ has preferably 6 to 15 carbon atoms and is preferably a phenyl group. In formula (I), L, $L_1$ and $L_2$ each represent a methine group or a substituted methine group =C(R')—. R' represents an alkyl group (e.g., methyl, ethyl), a substituted alkyl group (e.g., an alkoxyalkyl group such as 2-ethoxyethyl; a carboxyalkyl group such as 2-carboxyethyl; an alkoxycarbonylalkyl group such as 2-methoxycarbonylethyl; an aralkyl group such as benzyl or phenethyl), or an aryl group (e.g., phenyl, p-methoxyphenyl, p-chlorophenyl, o-carboxyphenyl). L and R, or $L_1$ and $R_1$ may be bonded to each other via a methine chain to form a 5-membered or 6-membered nitrogen-containing hetero ring. The substituent bonded to the 3-positioned nitrogen atom in the thiazolinone nucleus or imidazolinone nucleus formed by Q and $Q_1$ includes, for example, an alkyl group (preferably having from 1 to 8 carbon atoms such methyl, ethyl, propyl), an allyl group, an aralkyl group (in which the alkyl radical preferably has from 1 to 5 carbon atoms, such as benzyl, p-carboxyphenylmethyl), an aryl group (preferably having a total of from 6 to 9 carbon atoms, such as phenyl, p-carboxyphenyl), a hydroxyalkyl group (in which the alkyl radical preferably has from 1 to 5 carbon atoms, such as 2-hydroxyethyl), a carboxyalkyl group (in which the alkyl radical preferably has from 1 to 5 carbon atoms, such as carboxymethyl), and an alkoxycarbonylalkyl group (in which the alkyl radical in the alkoxy moiety preferably has from 1 to 3 carbon atoms and the alkyl moiety preferably has from 1 to 5 carbon atoms, such as methoxycarbonylethyl).

Examples of the anion represented by X include a halide ion (e.g., iodide, bromide, chloride), a perchlorate ion, a thiocyanate ion, a benzenesulfonate ion, a p-toluenesulfonate ion, a methylsulfate ion, and an ethylsulfate ion.

The compounds of formula (II) are described below.

In formula (II), $R_2$ and $R_3$ may be same as or different from each other and each represents an alkyl group (including a substituted alkyl group). Preferably, the alkyl group represented by $R_2$ and $R_3$ has from 1 to 8 carbon atoms, such as methyl, ethyl propyl, butyl, pentyl, heptyl or octyl group.

Substituents for the substituted alkyl group represented by $R_2$ and $R_3$ include, for example, a carboxyl group, a sulfo group, a cyano group, a halogen atom (e.g., fluorine, chlorine, bromine), a hydroxyl group, an alkoxycarbonyl group (preferably having 8 or less carbon atoms, such as methoxycarbonyl, ethoxycarbonyl, benzyloxycarbonyl), an alkoxy group (preferably having 1 to 7 carbon atoms, such as methoxy, ethoxy, propoxy, butoxy, benzyloxy), an aryloxy group (e.g., phenoxy, p-tolyloxy), an acyloxy group (preferably having 3 or less carbon atoms, such as acetyloxy, propionyloxy), an acyl group (preferably having 8 or less carbon atoms, such as acetyl, propionyl, benzoyl, mesyl), a carbamoyl group (e.g., carbamoyl, N,N-dimethylcarbamoyl, morpholinocarbamoyl, piperidinocarbamoyl), a sulfamoyl group (e.g., sulfamoyl, N,N-dimethylsulfamoyl, morpholinosulfonyl), and an aryl group (e.g., phenyl, p-hydroxyphenyl, p-carboxyphenyl, p-sulfophenyl, α-naphthyl). The alkyl moiety of the substituted alkyl group preferably has 6 or less carbon atoms. Two or more of these substituents may be substituted in the substituted alkyl group.

$R_4$ represents a hydrogen atom, a lower alkyl group (preferably having from 1 to 4 carbon atoms, such as methyl, ethyl, propyl, butyl), a lower alkoxy group (preferably having from 1 to 4 carbon atoms, such as methoxy, ethoxy, propoxy, butoxy), a phenyl group, a benzyl group, or a phenethyl group. $R_4$ more preferably represents a lower alkyl group or a benzyl group.

V represents a hydrogen atom, a lower alkyl group (preferably having from 1 to 4 carbon atoms, such as methyl, ethyl, propyl), an alkoxy group (preferably having from 1 to 4 carbon atoms, such as methoxy, ethoxy, butoxy), a halogen atom (e.g., fluorine, chlorine), or a substituted alkyl group (preferably having from 1 to 4 carbon atoms, e.g., trifluoromethyl, carboxymethyl).

$Z_2$ represents a non-metallic atomic group necessary for completing a 5-membered or 6-membered nitrogen-containing hetero ring, such as thiazole nuclei (e.g., benzothiazole, 4-chlorobenzothiaozle, 5-chlorobenzothiazole, 6-chlorobenzothiazole, 7-chlorobenzothiazole, 4-methylbenzothiazole, 5-methylbenzothiaozle, 6-mehtylbenzothiazole, 5-bromobenzothiazole, 6-bromobenzothiazole, 5-iodobenzothiazole, 5-phenylbenzothiaozle, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-hydroxy-6-methylbenzothiaozle, tetrahydrobenzothiazole, 4-phenylbenzothiaozle, naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole), selenazole nuclei (e.g., benzoselenazole, 5-chlorobenzoselenazole, 5-methoxybenzoselenazole, 5-methylbenzoselenazole, 5-hydroxybenzoselenaozle, naphtho[2,1-d]selenazole, naphtho[1,2-d]selenazole), oxazole nuclei (e.g., benzoxazole, 5-chlorobenzoxazole, 5-methylbenzoxazole, 5-bromobenzoxazole, 5-fluorobenzoxaozle, 5-phenylbenzoxazole, 5-methoxybenzoxazole, 5-trifluoromethylbenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethylbenzoxaozle, 4,6-dimethylbenzoxazole, 5-ethoxybenzoxazole, naphtho[2,1-d]oxazole, naphtho[1,2-d]oxazole, naphtho[2,3-d]oxazole), quinoline nuclei (e.g., 2-quinoline, 3-mehtyl-2-quinoline, 5-ethyl-2-quinoline, 6-methyl-1-quinoline, 8-fluoro-2-quinoline, 6-methoxy-2-quinoline, 6-hydroxy-2-quinoline, 8-chloro-2-quinoline, 8-fluoro-4-quinoline), 3,3-dialkylindolenine nuclei (e.g., 3,3-dimethylindolenine, 3,3-diethylindolenine, 3,3-dimethyl-5-cyanoindolenine, 3,3-dimethyl-5-methoxyindolenine, 3,3-dimethyl-5-methylindolenine, 3,3-dimehtyl-5-chloroindolenine), imidazole nuclei (.e.g., 1-methylbenzimidazole, 1-ethylbenzimidazole, 1-mehtyl-5-chlorobenzimidazole, 1-ethyl-5-chlorobenzimidazole, 1-methyl-5,6-dichlorobenzimidazole, 1-ethyl-5,6-dichlorobenzimidaozle, 1-ethyl-5-methoxybenzimidazole, 1-methyl-5-cyanobenzimidazole, 1-ethyl-5-cyanobenzimidazole, 1-mehtyl-5-fluorobenzimidazole, 1-ethyl-5-fluorobenzimidazole, 1-phenyl-5,6-dichlorobenzimidazole, 1-allyl-5,6-dichlorobenzimidazole, 1-allyl-5-chlorobenzimidazole, 1-phenylbenzimidazole, 1-phenyl-5-chlorobenzimidazole, 1-methyl-5-trifluoromethylbenzimidazole, 1-ethyl-5-trifluoromethylbenzimidazole, 1-ethylnaphtho[1,2-d]imidazole), and pyridine nuclei (e.g., pyridine, 5-methyl-2-pyridine, 3-methyl-4-pyridine). Of them, more preferred are thiazole nuclei and oxazole nuclei. Particularly preferred are benzothiazole nuclei, naphthothiazole nuclei, naphthoxazole nuclei and benzoxazole nuclei. m, p and q independently represent 1 or 2.

Where the dye forms an internal salt, q is 1.

$X_1$ represents an acid anion (e.g., chloride, bromide, iodide, tetrafluoroborato, hexafluorophosphato, methylsulfato, ethylsulfato, ethylsulfato, benzenesulfonato, 4-methylbenzenesulfonato, 4-chloroebenzeneesulfonato, 4-nitrobenzenesulfonato, trifluoromethanesulfonato, perchlorato).

The compounds of formula (III) are described below.

$R_1'$ and $R_2'$ may be same as or different from each other and each represents an alkyl group (including a substituted alkyl group). Preferably, the alkyl group represented by $R_1'$ and $R_2'$ has from 1 to 8 carbon atoms, such as methyl, ethyl propyl, butyl, pentyl, heptyl or octyl group.

Substituents for the substituted alkyl group include, for example, a carboxyl group, a sulfo group, a cyano group, a halogen atom (e.g., fluorine, chlorine, bromine), a hydroxyl group, an alkoxycarbonyl group (preferably having 8 or less carbon atoms, such as methoxycarbonyl, ethoxycarbonyl, benzyloxycarbonyl), an alkoxy group (preferably having 1 to 7 carbon atoms, such as methoxy, ethoxy, propoxy, butoxy, benzyloxy), an aryloxy group (e.g., phenoxy, p-tolyloxy), an acyloxy group (preferably having 3 or less carbon atoms, such as acetyloxy, propionyloxy), an acyl group (preferably having 8 or less carbon atoms, such as acetyl, propionyl, benzoyl, mesyl), a carbamoyl group (e.g., carbamoyl, N,N-dimethylcarbamoyl, morpholinocarbamoyl, piperidinocarbamoyl), a sulfamoyl group (e.g., sulfamoyl, N,N-dimethylsulfamoyl, morpholinosulfonyl), and an aryl group (e.g., phenyl, p-hydroxyphenyl, p-carboxyphenyl, p-sulfophenyl, α-naphthyl). The alkyl moiety of the .substituted alkyl group preferably has 6 or less carbon atoms. Two or more of these substituents may be substituted in the substituted alkyl group.

$R_3'$ and $R_4'$ each represent a hydrogen atom, a lower alkyl group (preferably having from 1 to 4 carbon atoms, such as methyl, ethyl, propyl, butyl), a lower alkoxy group (preferably having from 1 to 4 carbon atoms, such as methoxy, ethoxy, propoxy, butoxy), a phenyl group, a benzyl group or a phenethyl group. More preferably, $R_3'$ and $R_4'$ each represents a lower alkyl group or a benzyl group.

$R_5'$ and $R_6'$ each represents a hydrogen atom, or they may be bonded to each other to form a divalent alkylene group (e.g., methylene, trimethylene). The alkylene group may optionally be substituted by one or more suitable substituents, for example, selected from an alkyl group (preferably having from 1 to 4 carbon atoms, such as methyl, ethyl, propyl, isopropyl, butyl), a halogen atom (e.g., chlorine, bromine), and an alkoxy group (preferably having from 1 to 4 carbon atoms, such as methoxy, ethoxy, propoxy, isopropoxy, butoxy).

$R_7'$ represents a hydrogen atom, a lower alkyl group (preferably having from 1 to 4 carbon atoms, such as methyl, ethyl, propyl), a lower alkoxy group (preferably having from 1 to 4 carbon atoms, such as methoxy, ethoxy, propoxy, butoxy), a phenyl, group, a benzyl group, or —$N(W_1')(W_2')$. $W_1'$ and $W_2'$ independently represent an alkyl group (including a substituted alkyl group, in which the alkyl moiety preferably has from 1 to 18 carbon atoms, more preferably from 1 to 4 carbon atoms, such as methyl, ethyl, propyl, butyl, benzyl, phenethylethyl), or an aryl group (preferably having 6 to 15 carbon atoms and including a substituted phenyl group, such as phenyl, naphthyl, tolyl, p-chlorophenyl); or $W_1'$ and $W_2'$ may be bonded to each other to form a 5-membered or 6-membered nitrogen-containing heterocyclic group. $R_3'$ and $R_7'$, or $R_4'$ and $R_7'$ each may be bonded to each other to form a divalent alkylene group having the same meaning as the divalent alkylene group formed when $R_5'$ and $R_6'$ are bonded to each other.

$Z'$ and $Z_1'$ each represent a non-metallic atomic group necessary for completing a 5-membered or 6-membered nitrogen-containing hetero ring, such as thiazole nuclei (e.g., benzothiazole, 4-chlorobenzothiaozle, 5-chlorobenzothiazole, 6-chlorobenzothiazole, 7-chlorobenzothiazole, 4-methylbenzothiazole, 5-methylbenzothiaozle, 6-methylbenzothiazole, 5-bromobenzothiazole, 6-bromobenzothiazole, 5-iodobenzothiazole, 5-phenylbenzothiaozle, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole, naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole), selenazole nuclei (e.g., benzoselenazole, 5-chlorobenzoselenazole, 5-methoxybenzoselenazole, 5-methylbenzoselenaozle, 5-hydroxybenzoselenazole, naphtho[2,1-d]selenazole, naphtho[1,2-d]selenazole), oxazole nuclei (e.g., benzoxazole, 5-chlorobenzoxazole, 5-methylbenzoxazole, 5-bromobenzoxazole, 5-fluorobenzoxaozle, 5-phenylbenzoxazole, 5-methoxybenzoxazole, 5-trifluoromethylbenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethylbenzoxaozle, 4,6-dimethylbenzoxazole, 5-ethoxybenzoxazole, naphtho[2,1-d]oxazole, naphtho[1,2-d]oxazole, naphtho[2,3-d]oxazole), quinoline nuclei (e.g., 2-quinoline, 3-mehtyl-2-quinoline, 5-ethyl-2-quinoline, 6-methyl-1-quinoline, 8-fluoro-2-quinoline, 6-methoxy-2-quinoline, 6-hydroxy-2-quinoline, 8-chloro-2-quinoline, 8-fluoro-4-quinoline), 3,3-dialkylindolenine nuclei (e.g., 3,3-dimethylindolenine, 3,3-diethylindolenine, 3,3-dimethyl-5-cyanoindolenine, 3,3-dimethyl-5-methoxyindolenine, 3,3-dimethyl-5-methylindolenine, 3,3-dimethyl-5-chloroindolenine), imidazole nuclei (e.g., 1-methylbenzimidazole, 1-ethylbenzimidazole, 1-mehtyl-5-chlorobenzimidazole, 1-ethyl-5-chlorobenzimidaozle, 1-methyl-5,6-dichlorobenzimidazole, 1-ethyl-5,6-dichlorobenzimidaozle, 1-ethyl-5-methoxybenzimidazole, 1-methyl-5-cyanobenzimidazole, 1-ethyl-5-cyanobenzimidazole, 1-mehtyl-5-fluorobenzimidazole, 1-ethyl-5-fluorobenzimidazole, 1-phenyl-5,6-dichlorbenzimidazole, 1-allyl-5,6-dichlorobenzimidazole, 1-allyl-5-chlorobenzimidazole, 1-phenylbenzimidazole, 1-phenyl-5-chlorobenzimidazole, 1-methyl-5-trifluoromethylbenzimidazole, 1-ethyl-5-trifluoromethylbenzimidazole, 1-ethylnaphtho[1,2-d]imidazole), and pyridine nuclei (e.g., pyridine, 5-methyl-2-pyridine, 3-methyl-4-pyridine). Of them, advantageous are thiazole nuclei and oxazole nuclei. Especially advantageous are benzothiazole nuclei, naphthothiazole nuclei, naphthoxazole nuclei and benzoxazole nuclei.

$X_1^-$ represents an acid anion (e.g., chloride, bromide, iodide, tetrafluoroborato, hexafluorophosphato, methylsulfato, ethylsulfato, benzenesulfonato, 4-methylbenzensulfonato, 4-chlorobenzenesulfonato, 4-nitrobenzenesulfonato, trifluoromethanesulfonato, perchlorato).

$m^1$ represents 0 or 1. When the dye forms an internal salt, then $m^1$ is 1.

Specific examples of compounds of formulae (I) to (III) are given below, however, the present invention should not be construed as being limited thereto.

I-1

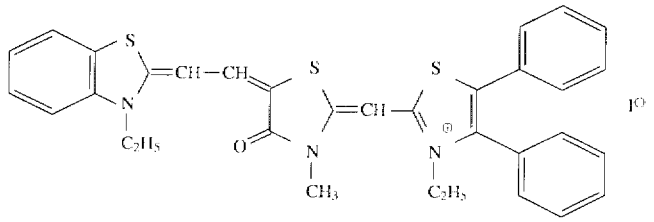

I-2

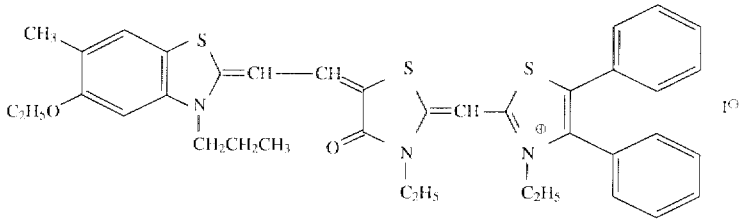

I-3

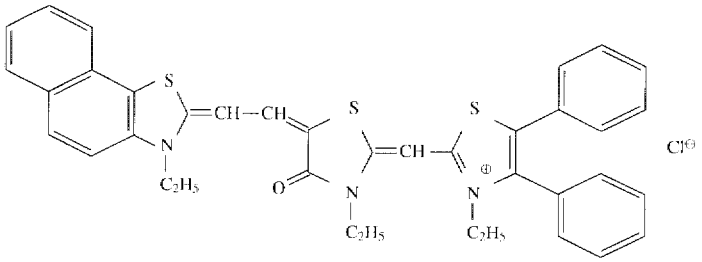

I-4

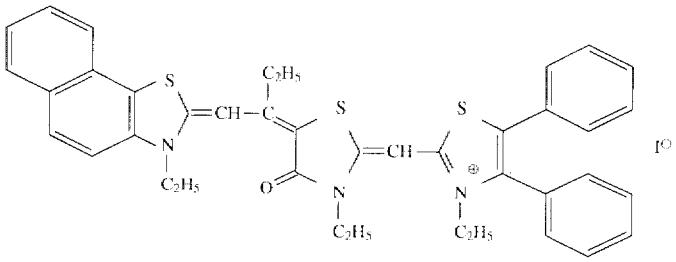

I-5

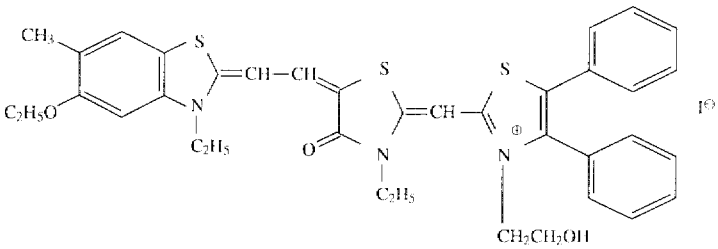

I-6

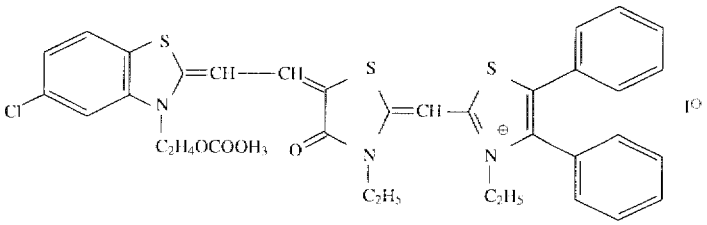

-continued
I-7
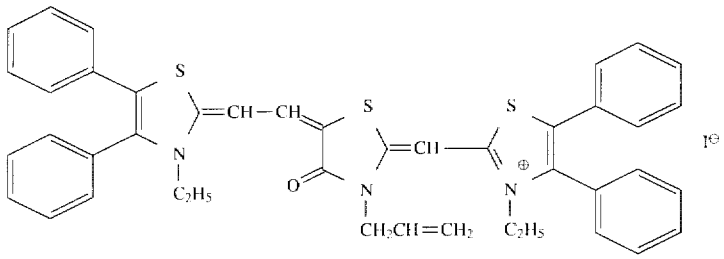
I-8
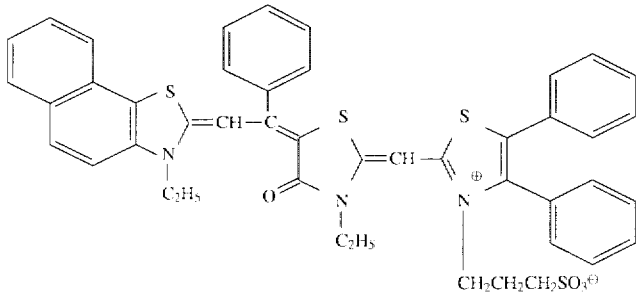
I-9
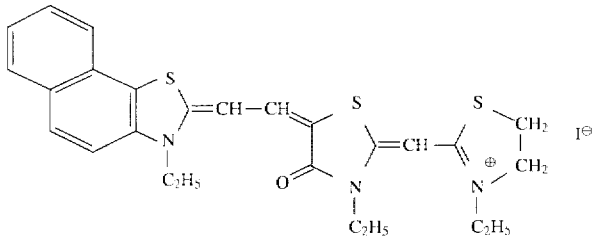
I-10
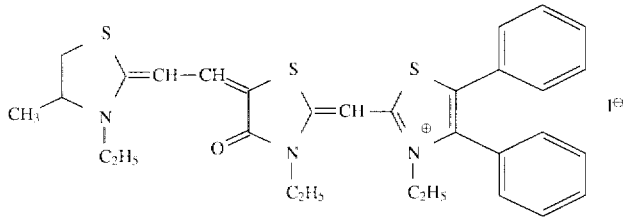
I-11
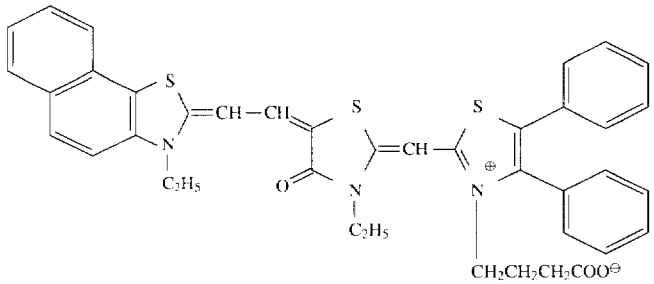
I-12
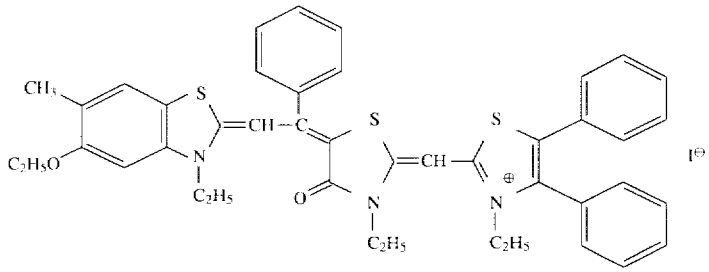

-continued
I-13
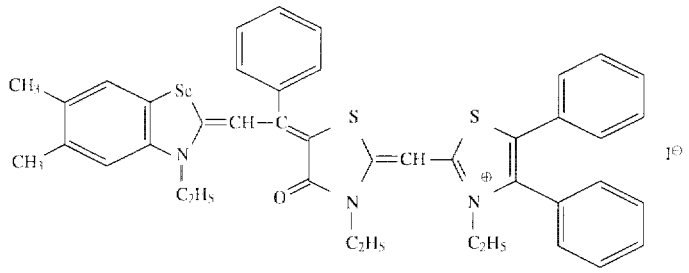
I-14
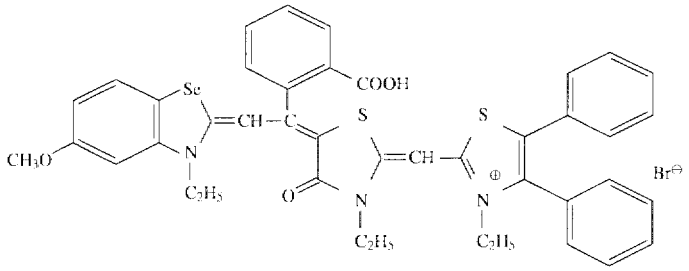
I-15
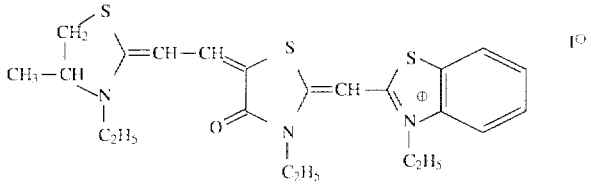
I-16
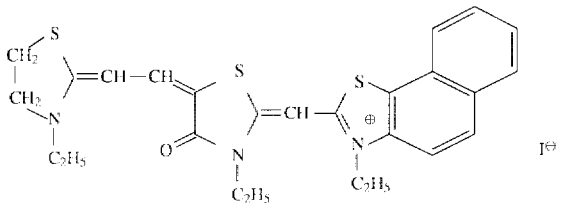
I-17
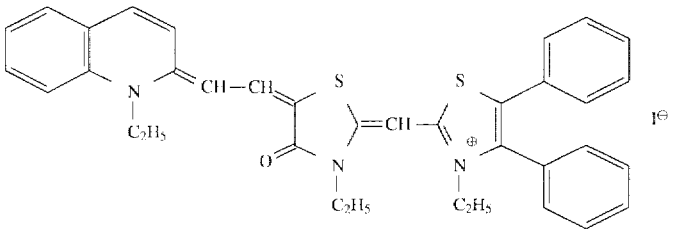
I-18
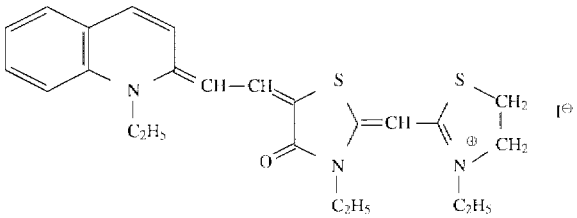
I-19
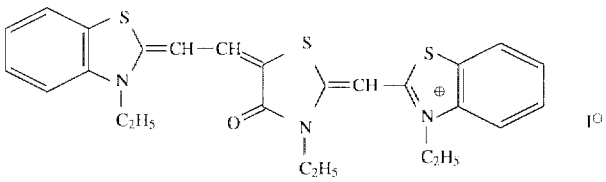

-continued
I-20
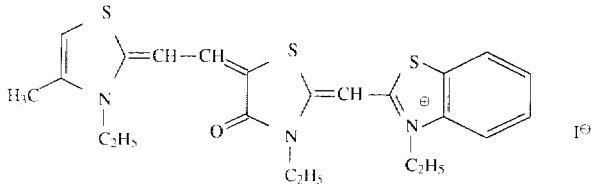
I-21
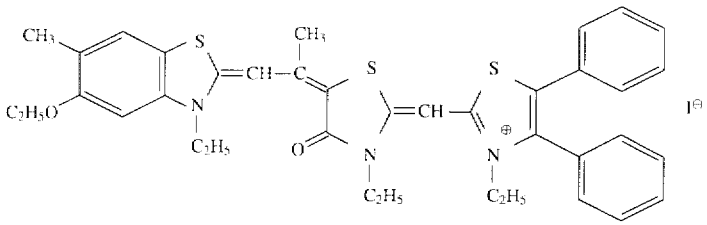
I-22
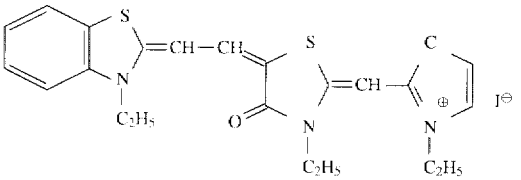
I-23
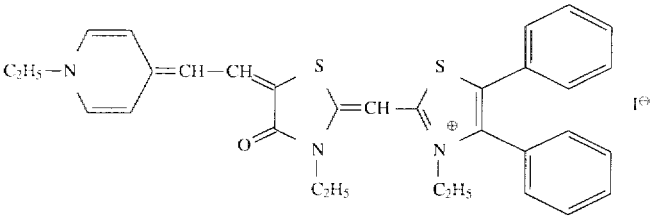
I-24
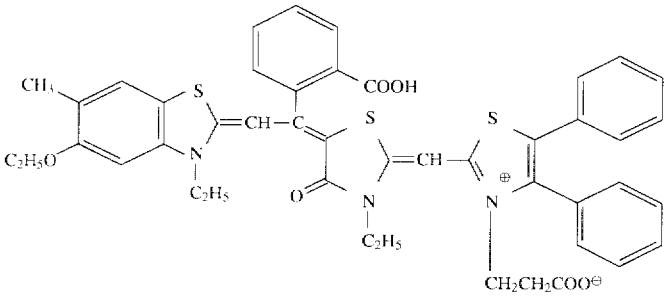
I-25
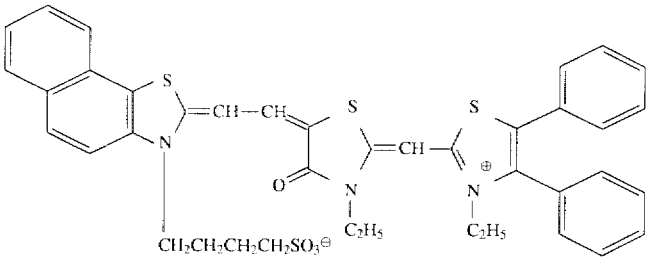
I-26
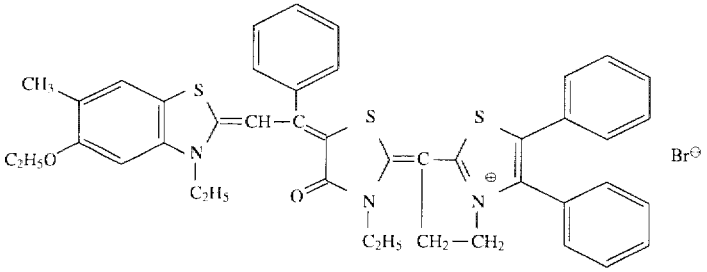

-continued
I-27
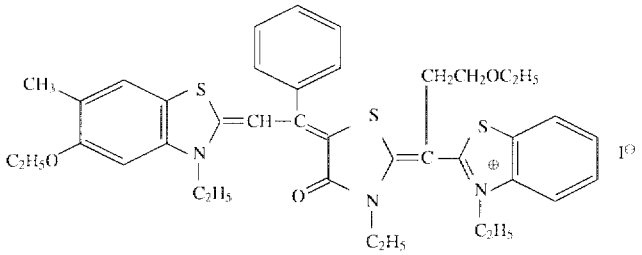
I-28
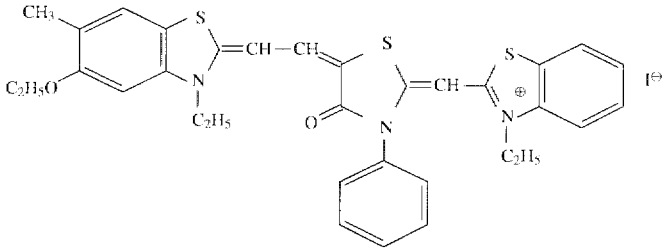
I-29
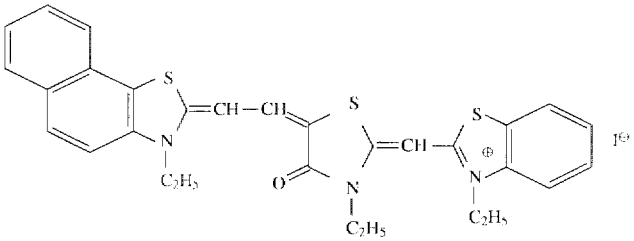
I-30
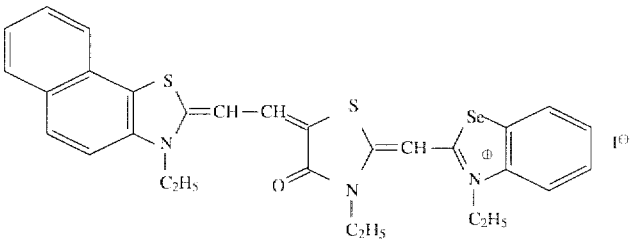
I-31
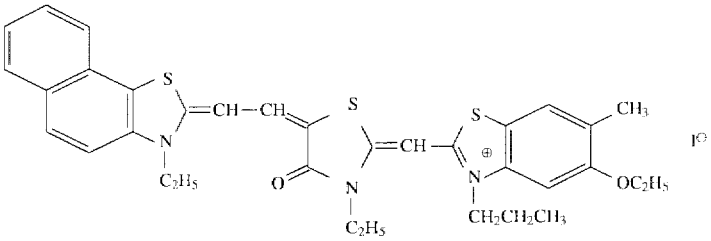
I-32
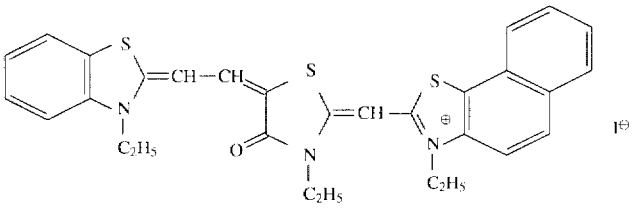

-continued
I-33
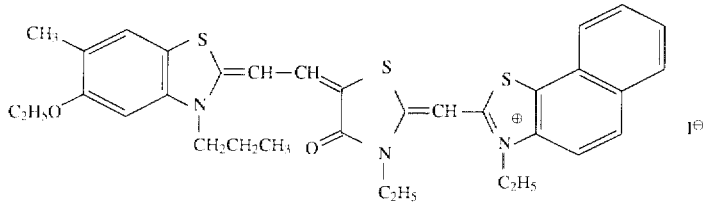
I-34
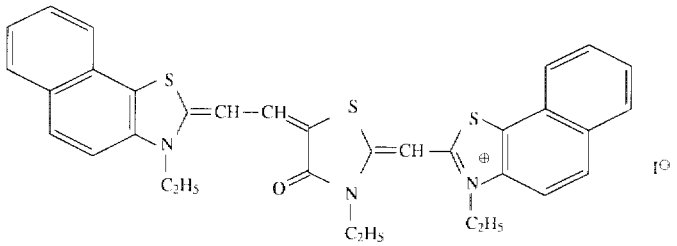
I-35
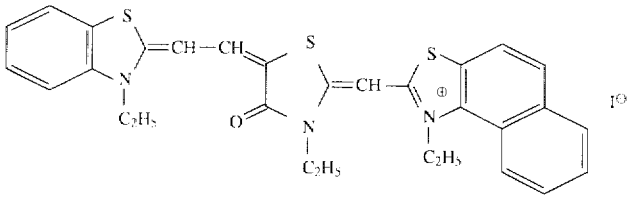
I-36
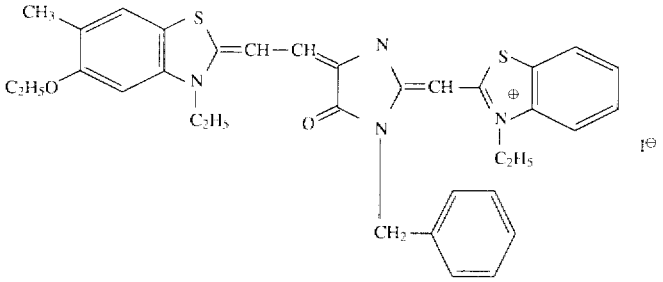
I-37
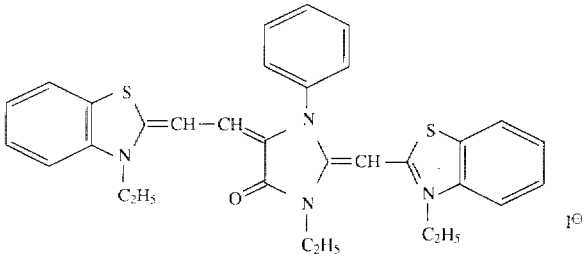
I-38
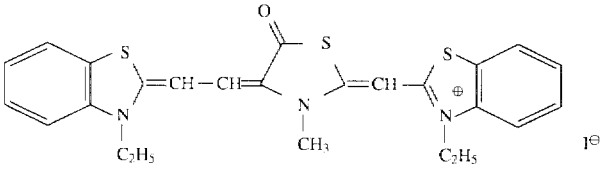
II-39
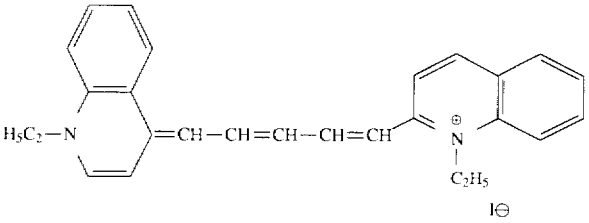

-continued
II-40
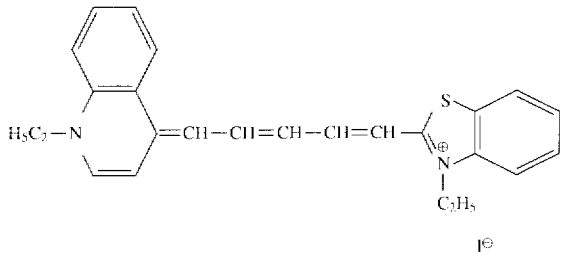
II-41
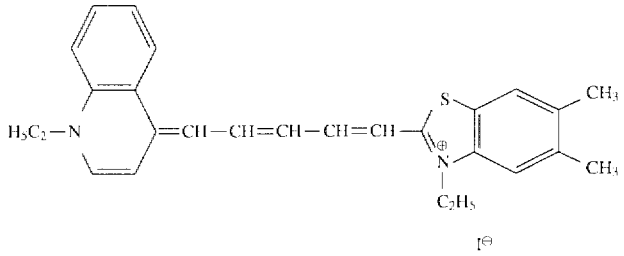
II-42
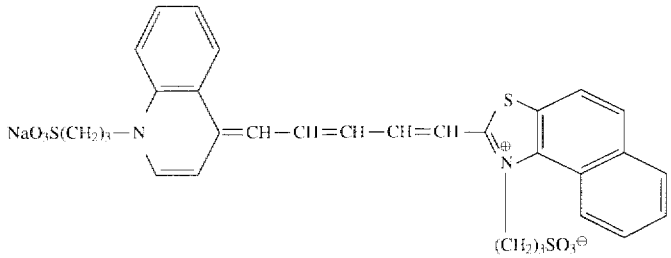
II-43
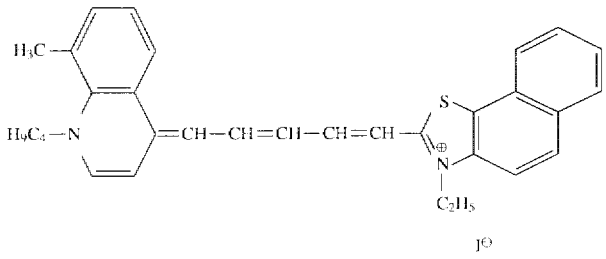
II-44
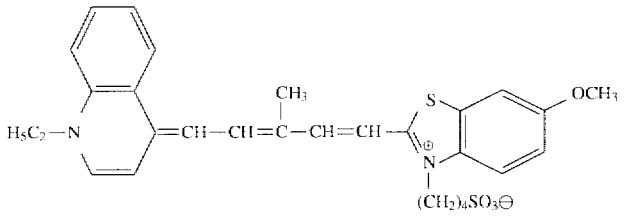
II-45
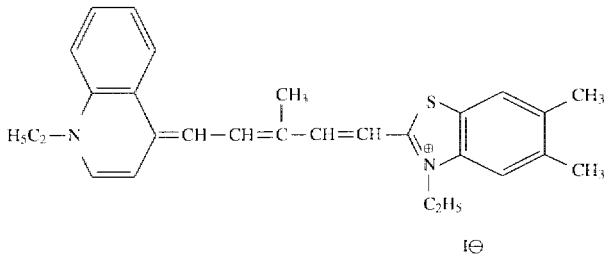

-continued
II-46
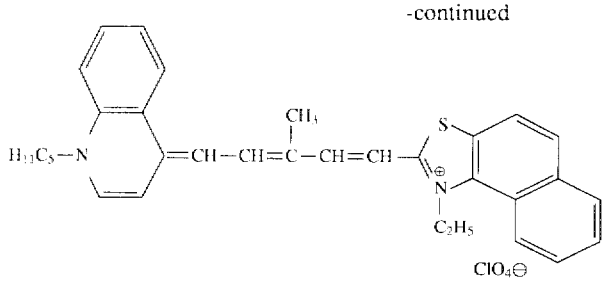
II-47
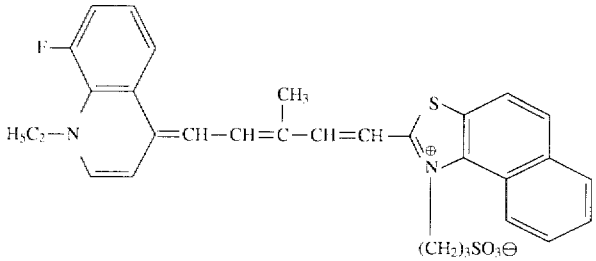
II-48
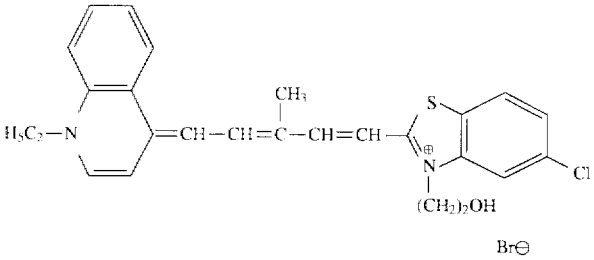
II-49
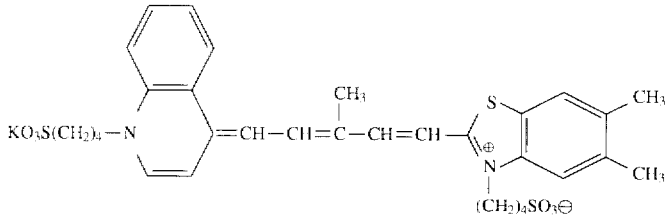
II-50
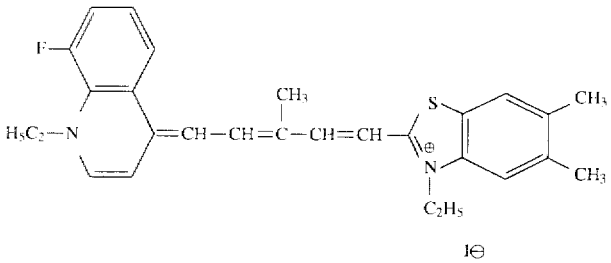
II-51
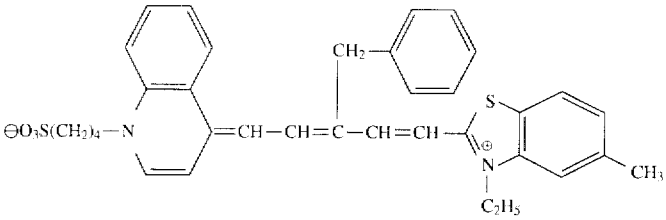

-continued
II-52
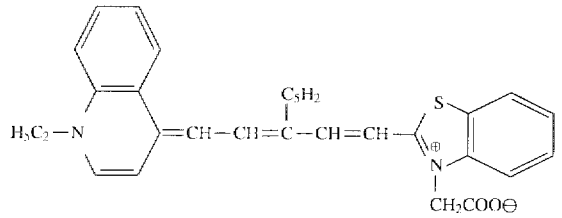
II-53
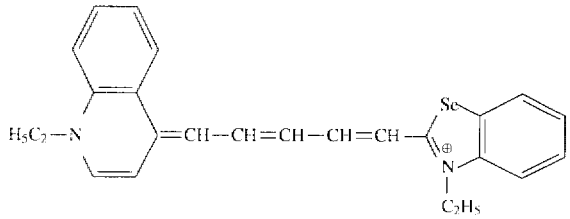
I⊖
II-54
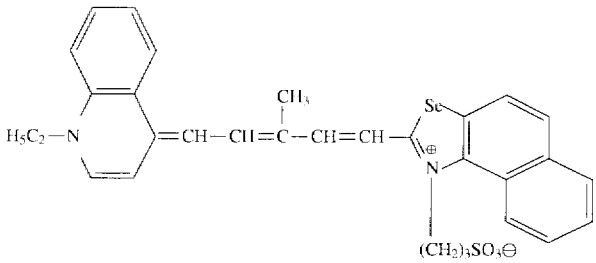
II-55
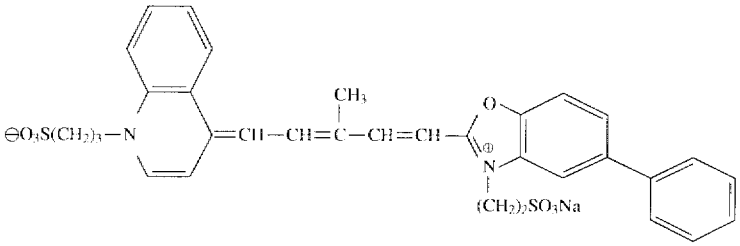
II-56
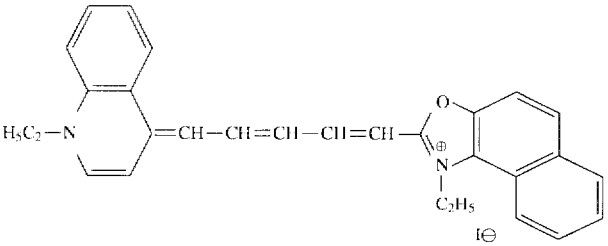
I⊖
II-57
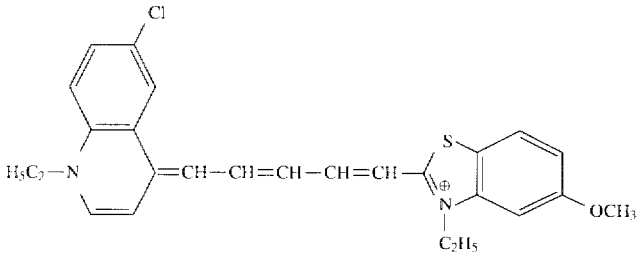
$ClO_4$⊖

-continued
II-58
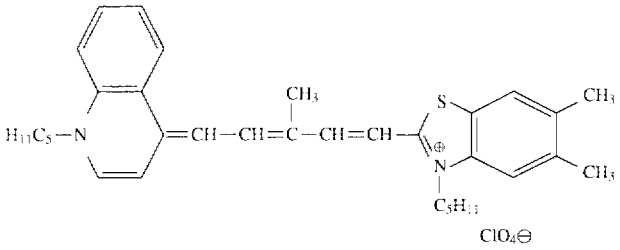
III-59
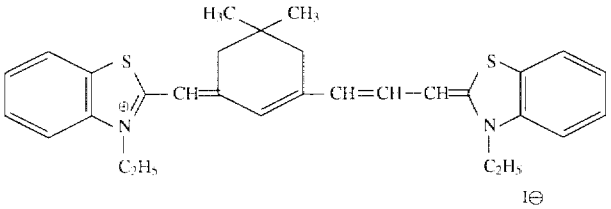
III-60
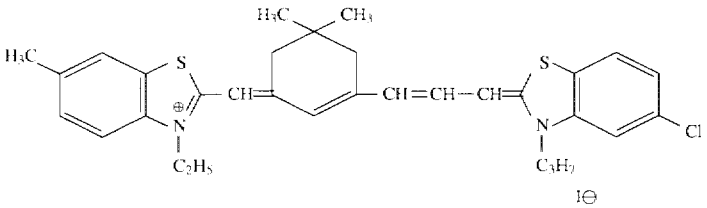
III-61
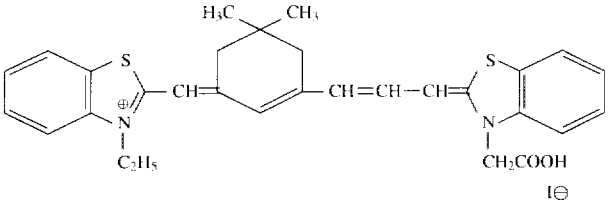
III-62
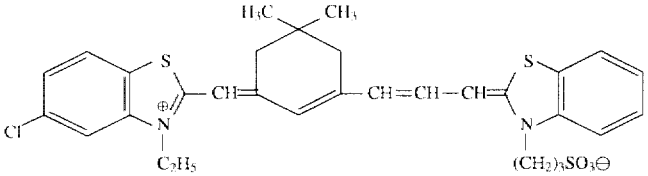
III-63
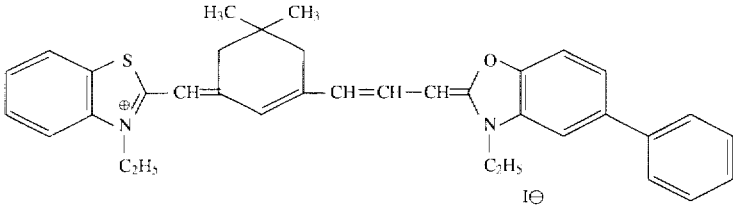
III-64
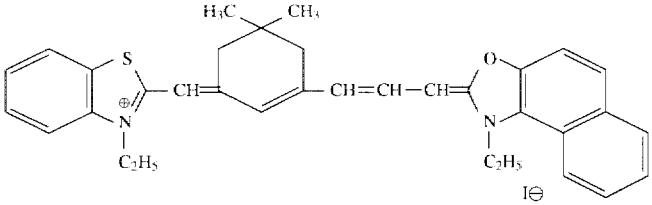

-continued
III-65
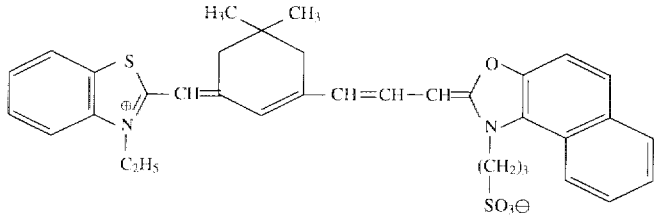
III-66
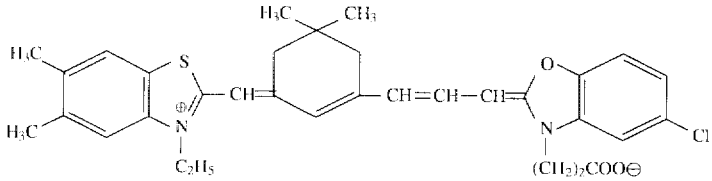
III-67
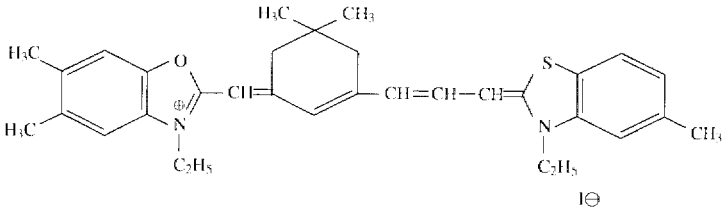
III-68
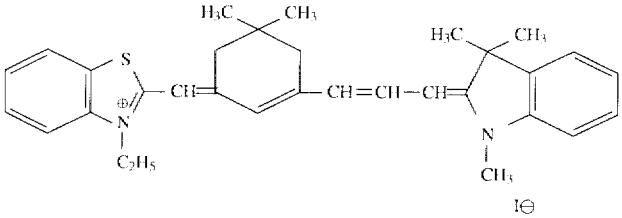
III-69
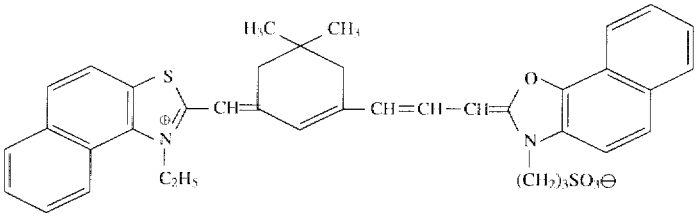
III-70
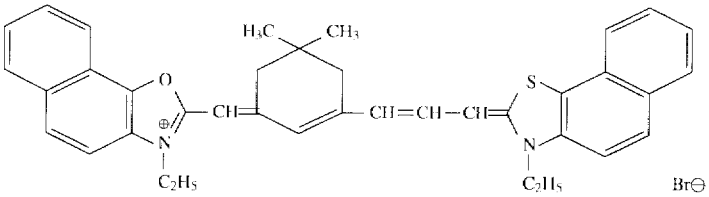
III-71
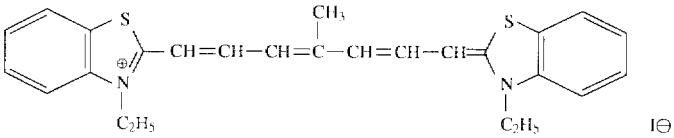
III-72
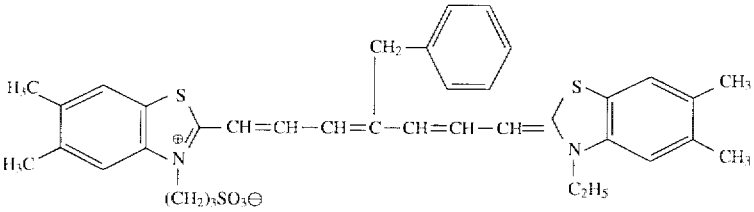

-continued

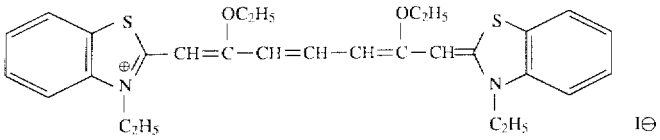

III-73

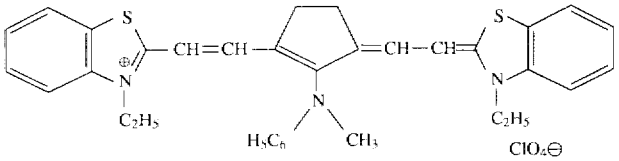

III-74

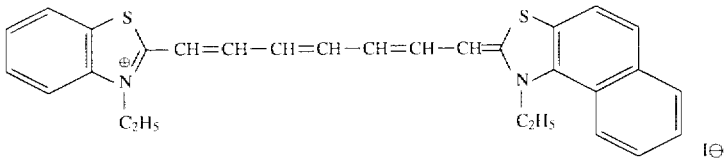

III-75

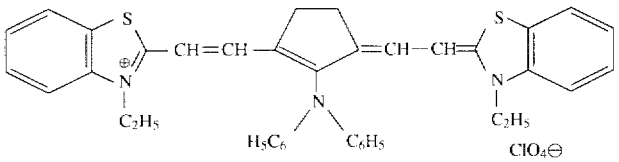

III-76

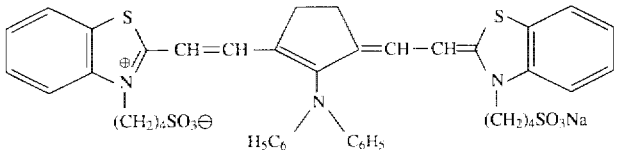

III-77

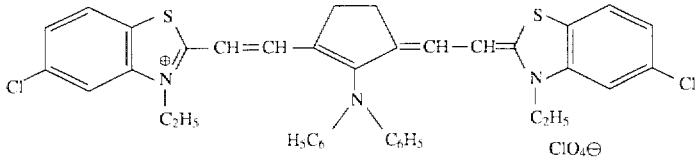

III-78

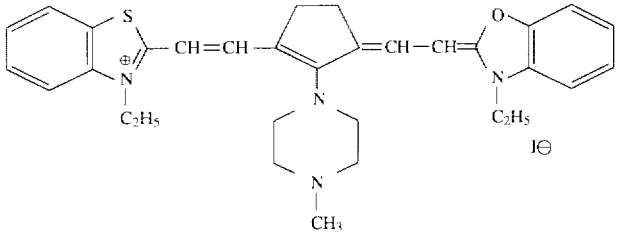

III-79

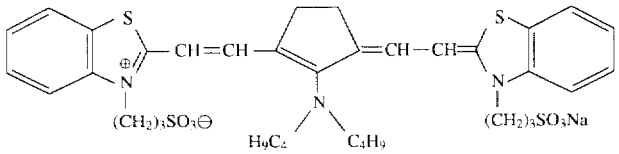

III-80

The spectral sensitizing dyes represented by formulae (I), (II) and (III) may be used singly or in combination thereof. A combination of sensitizing dyes is often employed for the purpose of super-sensitization. The emulsion constituting the photographic material of the present invention can contain, along with the spectral sensitizing dye(s) of formulae (I) to (III), dyes which do not impart a spectral sensitizing effect, or substances which do not substantially absorb visible rays but exhibit super-sensitization.

Useful sensitizing dyes, combinations thereof with dyes imparting super-sensitization, and substances which impart super-sensitization are described in *Research Disclosure*, Vol. 176, No. 17643 (issued December 1978), page 23, IV-J and in JP-B-49-25500, JP-B-43-4933, and JP-A-59-19032, JP-A-59-192242.

The addition amount of the spectral sensitizing dye(s) represented by formulae (I) to (III) to the photographic material of the present invention is desirably selected to provide optimal sensitization, in accordance with the grain size and halogen composition of the silver halide grains in the emulsion, the method and degree of chemical sensitization of the grains, the relationship between the layer of containing the dye(s) and the silver halide emulsion in the layer and the kind of the anti-foggant present in the material. The test method for selecting the optimal sensitizing amount is well known by those skilled in the art. Preferably, in general, the addition amount of the spectral sensitizing dye(s) represented by formulae (I) to (III) is from $1\times10^{-7}$ mol to $1\times10^{-2}$ mol, particularly preferably from $1\times10^{-6}$ to $5\times10^{-3}$ mol, per mol of the silver halide.

If desired, the compounds represented by formula (VII) below may be used in the emulsion as a super-sensitizer in the present invention.

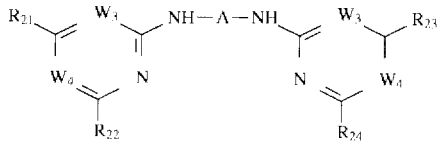

(VII)

In formula (VII), —A— represents a divalent aromatic residue, which may contain $—SO_3M$ wherein M represents a hydrogen atom or a cation for making the compound soluble in water, such as sodium or potassium.

—A— is advantageously selected from the following $—A_1—$ and $—A_2—$. When $R_{21}$, $R_{22}$, $R_{23}$ or $R_{24}$ in formula (VII) do not contain $—SO_3M$, then —A— is selected from the group of $—A_1—$.

$—A_1—$:

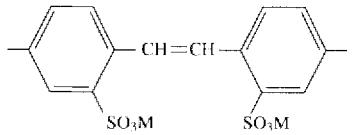

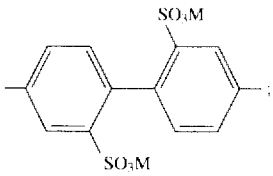

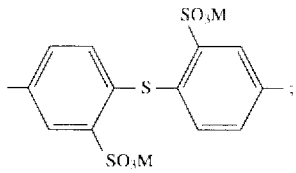

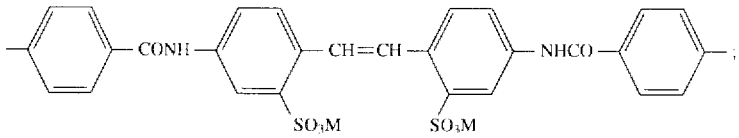

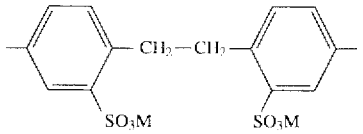

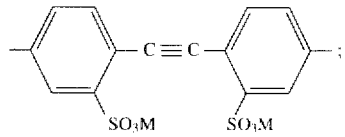

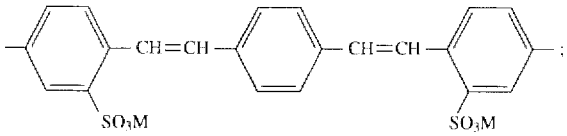

-continued

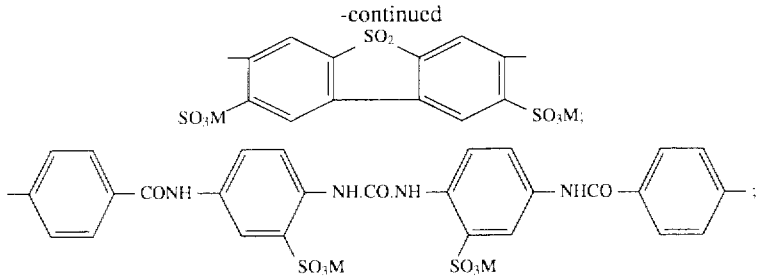

$-A_2-$:

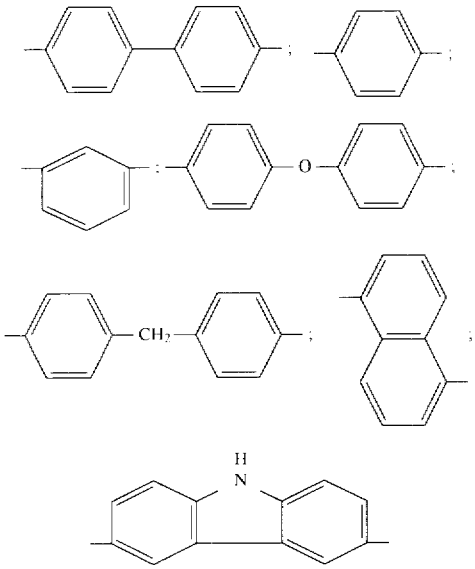

$R_{21}$, $R_{22}$, $R_{23}$ and $R_{24}$ each represent a hydrogen atom, a hydroxyl group, a lower alkyl group (preferably having from 1 to 8 carbon atoms, such as methyl, ethyl, n-propyl, n-butyl), an alkoxy group (preferably having from 1 to 8 carbon atoms, such as methoxy, ethoxy, propoxy, butoxy), an aryloxy group (e.g., phenoxy, naphthoxy, o-tolyloxy, p-sulfophenoxy), a halogen atom (e.g., chlorine, bromine), a heterocyclic group (e.g., morpholinyl, piperidyl), an alkylthio group (e.g., methylthio, ethylthio), a heterocyclylthio group (e.g., benzothiazolylthio, benzimidazolylthio, phenyltetrazolylthio), an arylthio group (e.g., phenylthio, tolylthio), an amino group, an alkylamino or substituted alkylamino group (e.g., methylamino, ethylamino, propylamino, dimethylamino, diethylamino, dodecylamino, cyclohexylamino, β-hydroxyethylamino, di-(β-hydroxyethyl)amino, β-sulfoethylamino), an arylamino or substituted arylamino group (e.g., anilino, o-sulfoanilino, m-sulfoanilino, p-sulfoanilino, o-toluidino, m-toluidino, p-toluidino, o-carboxyanilino, m-carboxyanilino, p-carboxyanilino, o-chloroanilino, m-chloroanilino, p-chloroanilino, p-aminoanilino, o-anisidino, m-anisidino, p-anisidino, o-acetaminoanilino, hydroxyanilino, disulfophenylamino, naphthylamino, sulfonaphthylamino), a heterocyclyl amino group (e.g., 2-benzothiazolylamino, 2-pyridylamino), a substituted or unsubstituted aralkylamino group (e.g., benzylamino, o-anisylamino, m-anisylamino, p-anisylamino), an aryl group (e.g., phenyl), or a mercapto group. $R_{21}$, $R_{22}$, $R_{23}$ and $R_{24}$ may be same as or different from each other. Where —A— is selected from the group of $—A_2—$, at least one of $R_{21}$, $R_{22}$, $R_{23}$ and $R_{24}$ must have a sulfo group (either in the form of a free acid group or in the form of a salt). $W_3$ and $W_4$ each represent —CH= or —N=, and at least one $W_3$ and $W_4$ is —N=.

Specific examples of compounds of formula (VII) are given below, however, the present invention should not be construed to be limited thereto.

(VII-1) Disodium 4,4'-bis[4,6-di(benzothiazolyl-2-thio)pyrimidin-2-ylamino]stilbene-2,2'-disulfonate (VII-2) Disodium 4,4'-bis[4,6-di(benzothiazolyl-2-amino)pyrimidin-2-ylamino)]stilbene-2,2'-disulfonate (VII-3) Disodium 4,4'-bis[4,6-di(naphthyl-2-oxy)-pyrimidin-2-ylamino]stilbene-2,2'-disulfonate (VII-4) Disodium 4,4'-bis[4,6-di(naphthyl-2-oxy)-pyrimidin-2-ylamino]bibenzyl-2,2'-disulfonate (VII-5) Disodium 4,4'-bis(4,6-dianilinopyrimidin-2-ylamino)stilbene-2,2'-disulfonate (VII-6) Disodium 4,4'-bis[4-chloro-6-(2-naphthyloxy)-pyrimidin-2-ylamino]biphenyl-2,2'-disulfonate (VII-7) Disodium 4,4'-bis[4,6-di(1-phenyltetrazolyl-5-thio)pyrimidin-2-ylamino]stilbene-2,2'-disulfonate (VII-8) Disodium 4,4'-bis[4,6-di(benzimidazolyl-2-thio)pyrimidin-2-ylamino]stilbene-2,2'-disulfonate (VII-9) Disodium 4,4'-bis[4,6-diphenoxypyrimidin-2-ylamino)stilbene-2,2'-disulfonate (VII-10) Disodium 4,4'-bis[4,6-diphenylthiopyrimidin-2-ylamino)stilbene-2,2'-disulfonate (VII-11) Disodium 4,4'-bis[4,6-dimercaptopyrimidin-2-ylamino)biphenyl-2,2'-disulfonate (VII-12) Disodium 4,4'-bis[4,6-dianilino-triazin-2-ylamino]stilbene-2,2'-disulfonate (VII-13) Disodium 4,4'-bis(4-anilino-6-hydroxy-triazin-2-ylamino)stilbene-2,2'-disulfonate (VII-14) Disodium 4,4'-bis[4-naphthylamino-6-anilinotriazin-2-ylamino]stilbene-2,2'-disulfonate (VII-15) 4,4'-Bis[2,6-di(2-naphthoxy)pyrimidin-4-ylamino]stilbene-2,2'-disulfonic acid (VII-16) Disodium 4,4'-bis[2,6-di(2-naphthylamino)-pyrimidin-4-ylamino]stilbene-2,2'-disulfonate (VII-17) Disodium 4,4'-bis[2,6-dianilinopyrimidin-4-ylamino)]stilbene-2,2'-disulfonate (VII-18) 4,4'-Bis[2-naphthylamino-6-anilinopyrimidin-4-ylamino]stilbene-2,2'-disulfonic acid (VII-19) Ditriethylammonium 4,4'-bis[2,6-diphenoxypyrimidin-4-ylamino]stilbene-2,2'-disulfonate (VII-20) Disodium 4,4'-bis[2,6-di(benzimidazolyl-2-thio)-pyrimidin-4-ylamino]stilbene-2,2'-disulfonate Compounds of formula (VII) are known or may easily be produced by known methods.

The amount of silver in the silver halide emulsion of the at least one silver halide photographic material of the present invention is 2.8 g/m$^2$ or less. The total amount of a hydrophilic colloid (e.g., gelatin) coated on the same side of the support as that having thereon the at least one silver halide emulsion layer is 3.5 g/m$^2$ or less.

The photographic material of the present invention can contain water-soluble dyes as a filter dye or for anti-irradiation or for various other purposes, in the hydrophilic colloid layers constituting the photographic material. Such dyes include, for example oxonol dyes, hemioxonol dyes, styryl dyes, merocyanine dyes, cyanine dyes and azo dyes.

Various compounds may be added to the photographic material of the present invention to prevent fogging of the material and to stabilize the photographic properties thereof, during manufacture, storage or processing. For example, various compounds known as anti-foggants or stabilizers may be used for this purpose, including, for example, azoles such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles; mercaptopyrimidines; mercaptotriazines; thioketo compounds such as oxazolinethiones; azaindenes such as triazaindenes, tetrazaindenes (especially, 4-hydroxy-substituted(1,3,3a,7)tetrazaindenes), pentazaindenes; and benzenethiosulfonic acids, benzenesulfinic acids, benzenesulfonic acid amides.

In particular, polyhydroxybenzene compounds are preferred as being effective for improving pressure resistance, without adversely affecting the sensitivity. Useful polyhydroxybenzene compounds preferably have anyone of the following structures:

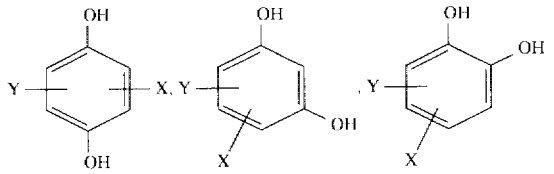

In the above formulae, X and Y each represents —H, —OH, a halogen atom, —OM (M is alkali metal ion such as Na and K), an alkyl group, a phenyl group, an amino group, a carbonyl group, a sulfone group, a sulfonated phenyl group, a sulfonated alkyl group, a sulfonated amino group, a sulfonated carbonyl group, a carboxyphenyl group, a carboxyalkyl group, a carboxyamino group, a hydroxyphenyl group, a hydroxyalkyl group, an alkylether group, an alkylphenyl group, an alkylthioether group, or a phenylthioether group.

More preferably, X and Y each represents —H, —OH, —Cl, —Br, —COOH, —$CH_2CH_2COOH$, —$CH_3$, —$CH_2CH_3$, —$CH(CH_3)_2$, —$C(CH_3)_3$, —$OCH_3$, —CHO, —$SO_3K$, —$SO_3H$, —$SCH_3$,

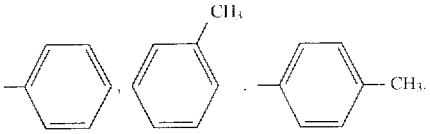

X and Y may be same as or different from each other.

Polyhydroxy compounds may be added to the emulsion layers or any other layers constituting the photographic material of the present invention. The addition amount thereof is effectively from $1\times10^{-5}$ to 1 mol, particularly preferably from $1\times10^{-3}$ mol to $1\times10^{-1}$ mol, per mol of silver halide.

The photographic emulsion layer constituting the photographic material of the present invention may contain a developing agent such as a polyalkylene oxide or an ether, ester or amine derivative thereof, a thioether compound, a thiomorpholine, a quaternary ammonium salt compound, a urethane derivative, a urea derivative, an imidazole derivative, a 3-pyrazolidone or aminophenol, to elevate the sensitivity, contrast and developability of the photographic material.

Of these developing agents, preferred are 3-pyrazolidones (e.g., 1-phenyl-3-pyrazolidone, 1-phenyl-4-methyl-4-hydroxymethyl-3-pyrazolidone). The content of the developing agent in the photographic material is generally 5 g/m$^2$ or less, preferably from 0.01 to 0.2 g/m$^2$.

The photographic emulsion and light-insensitive hydrophilic colloid of the photographic material of the present invention may contain an inorganic or organic hardening agent. Examples of the agents include active vinyl compounds (e.g., 1,3,5-triacryloyl-hexahydro-s-triazine, bis(vinylsulfonyl)methyl ether, N,N-methylene-bis-[β-(vinylsulfonyl)propionamide]), active halogen compounds (e.g., 2,4-dichloro-6-hydroxy-s-triazine), mucohalogenic acids (e.g., mucochloric acid), N-carbamoylpyridinium salts (e.g. , 1-morpholinocarbonyl-3-pyridiniomethane sulfonate), and haloamidinium salts (e.g., 1-(1-chloro-1-pyridinomethylene)pyrrolidinium 2-naphthalenesulfonate). They may be used singly or in combination. Of these, the active vinyl compound is described in JP-A-53-41220, JP-A-53-57257, JP-A-59-162546 and JP-A-60-80846 and the active halogen compounds described in U.S. Pat. No. 3,325,287 are preferred.

The photographic emulsion layer and other hydrophilic colloid layers constituting the photographic material of the present invention may contain various surfactants for use as a coating aid, improvement of anti-static property, improvement of sliding property, improvement of emulsification and dispersion, prevention of adhesion and improvement of photographic properties (e.g., promotion of developability, elevation of contrast and sensitization).

For example, useful surfactants include nonionic surfactants such as saponins (steroid type), alkylene oxide derivatives (e.g., polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, silicone-polyethylene oxide adducts), glycidol derivatives (e.g., alkenylsuccinic acid polyglycerides, alkylphenol polyglycerides), fatty acid esters of polyalcohols, and alkyl esters of saccharides; anionic surfactants containing acidic groups such as a carboxyl group, a sulfo group, a phospho group, a sulfato group or a phosphato group, for example, alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurins, sulfosuccinate esters, sulfoalkylpolyoxyethylene alkylphenyl ethers, and polyoxyethylene alkylphosphate esters; amphoteric surfactants such as amino acid salts, aminoalkylsulfonic acids, aminoalkylsulfuric acid esters or phosphoric acid esters, alkylbetains, and amine oxides; and cationic surfactants such as alkylamine salts, aliphatic or aromatic quaternary ammonium salts, heterocyclic quaternary ammonium salts (e.g., pyridiniums, imidazoliums), and aliphatic or heterocyclic phosphonium or sulfonium salts.

Fluorine-containing surfactants as described in JP-A-60-80849 are preferred for improving antistatic property of the photographic material.

The photographic material of the present invention may contain, in the photographic emulsion layer or other hydrophilic colloid layers, a matting agent such as silica, magnesium oxide or polymethyl methacrylate, for prevention of adhesion of the material.

The photographic material of the present invention may contain a dispersion of a water-insoluble or sparingly water-soluble synthetic polymer for improving the dimension stability of the photographic material. For example, useful polymers include polymers or copolymers derived from the monomer or comonomer components of alkyl (meth)acrylates, alkoxyalkyl (meth)acrylates and/or glycidyl (meth)-acrylates, optionally along with acrylic acids and/or methacrylic acids.

As the binder or protective colloid in the photographic emulsion, gelatin is advantageously used, but other hydrophilic colloids may also be used. For example, useful hydrophilic colloids include proteins such as gelatin derivatives, graft polymers of gelatin and other high molecular weight polymers, albumin and casein; cellulose derivatives such as hydroxyethyl cellulose, carboxymethyl cellulose and cellulose sulfuric acid esters; saccharide derivatives such as sodium alginate and other starch derivatives; and other various synthetic hydrophilic homopolymers or copolymers such as polyvinyl alcohol, polyvinyl alcohol partial acetal, poly-N-vinylpyrrolidone, polyacrylic acid, polymethacrylic acid, polyacrylamide, polyvinyl imidazole and polyvinylpyrazole.

Useful gelatins include lime-processed gelatin and acid-processed gelatin, as well as gelatin hydrolysates and enzyme-decomposed gelatin.

The silver halide emulsion layer constituting the photographic material of the present invention may contain a polymer latex such as an alkyl acrylate latex.

Useful as the support constituting the photographic material of the present invention include, for example, cellulose triacetate, cellulose diacetate, nitrocellulose, polystyrene or polyethylene terephthalate synthetic paper, baryta-coated paper, and polyolefin-coated paper.

The developing agent for development processing of the photographic material of the present invention contains preferably a dihydroxybenene or a 3-pyrazolidone represented by formula (IV) and more preferably 3-pyrazolidone to achieve high sensitivity of the photographic material.

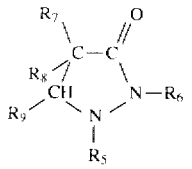

(IV)

where $R_5$ represents an aryl group; and $R_6$, $R_7$, $R_8$ and $R_9$ may be same as or different from one another and each represents a hydrogen atom, an alkyl group, an aryl group or an aralkyl group, provided that when $R_5$ is an unsubstituted phenyl group, then all of $R_6$, $R_7$, $R_8$ and $R_9$ are not hydrogen atoms at the same time.

Particularly preferred are hydroquinone, 1-phenyl-3-pyrazolidone and 1-phenyl-4-methyl-4-hydroxymethyl-3-pyrazolidone.

The dihydroxybenzene or 3-pyrazolidone is used in an amount of from 0.01 to 0.06 mol per liter of the developer.

The developer for developing the photographic material of the present invention contains a sulfite preservative, such as sodium sulfite, potassium sulfite, lithium sulfite, ammonium sulfite, sodium bisulfite, potassium metabisulfite or formaldehyde-sodium bisulfite. The content of the sulfite in the developer is preferably 0.25 mol/liter or more, especially preferably 0.4 mol/liter or more. The sulfite content should not exceed 2.5 mol/liter, and preferably does not exceed 1.2 mol/liter.

The alkali agent added to the developer to adjust the pH value thereof includes a pH adjusting agent or buffer, such as sodium hydroxide, potassium hydroxide, sodium carbonate or potassium carbonate.

In addition to the above-described components, the developer may further contain other additives, for example, a development inhibitor such as boric acid, borax or the like compound, as well as sodium bromide, potassium bromide or potassium iodide; an organic solvent such as ethylene glycol, diethylene glycol, triethylene glycol, dimethylformamide, methyl cellosolve, hexylene glycol, ethanol or methanol; and an antifoggant or black pepper inhibitor, for example, a mercapto compound such as 1-phenyl-5-mercaptotetrazole, sodium 2-mercaptobenzimdazole-5-sulfonate, an indazole compound such as 5-nitroindazole, benzotriazole compound such as 5-methylbenzotriazole. If desired, the developer may also contain a toning agent, a surfactant, a defoaming agent, a hard water softener, a hardening agent, and an amino compound such as those described in JP-A-56-106244, JP-A-61-267759 and JP-A-2-208652.

The developer may contain the compounds described in JP-A-56-24347 as a silver stain inhibitor, the compounds described in JP-A-62-212651 as a mottle inhibitor, and the compounds described in JP-A-61-267759 as a dissolution aid.

The developer may also contain boric acid as described in JP-A-62-186259, and saccharides (e.g., saccharose), oximes (e.g., acetoxime) and phenols (e.g., 5-sulfosalicylic acid) as described in JP-A-60-93433, as a buffer.

The photographic material of the present invention may be processed in the presence of a polyalkylene oxide. Where the developer for processing the photographic material contains a polyalkylene oxide, the polyethylene glycol preferably has a mean molecular weight of from 1000 to 6000 and the addition amount thereof is from 0.1 to 10 g/liter.

The fixer for processing the photographic material of the present invention may contain a water-soluble aluminium compound as a hardening agent. If desired, the fixer may contain acetic acid or a dibasic acid (e.g., tartaric acid, citric acid, salts thereof). Preferably, the fixer is an acidic solution containing the above described acid and has a pH of 3.8 or more, more preferably from 4.0 to 6.5.

The fixing agent contained in the fixer is preferably sodium thiosulfate or ammonium thiosulfate. To provide a rapid rate of fixation, ammonium thiosulfate is preferred. The addition amount of the fixing agent in the fixer varies depending on the intended application, but is generally from about 0.1 to 5 mol/liter.

The water-soluble aluminium compound for addition to the fixer as a hardening agent includes compounds generally known as a hardening agent for use in a conventional acidic hardening fixer. For example, the water-soluble aluminum compound includes aluminium chloride, aluminium sulfate and potassium alum.

As the above noted dibasic acid, tartaric acid and its derivatives and citric acid and its derivatives may be used, singly or in combination of two or more thereof. The addition amount of the dibasic acid or its derivative is effectively 0.005 mol or more, more effectively from 0.01 to 0.03 mol, per liter of the fixer.

Specifically, examples of the dibasic acid or its derivative include tartaric acid, potassium tartarate, sodium tartarate, sodium potassium tartarate, ammonium tartarate and potassium ammonium tartarate.

Useful examples of citric acid or its derivative for addition to the fixer of the present invention include citric acid, sodium citrate and potassium citrate.

The fixer may further contain, as needed, a preservative (e.g., sulfites, bisulfites), a pH buffer (e.g., acetic acid, boric acid), a pH adjusting agent (e.g., ammonia, sulfuric acid), an image storage enhancer (e.g., potassium iodide), and a chelating agent. The content of the pH buffer in the fixer is preferably from 10 to 40 g/liter, more preferably from 18 to 25 g/liter, especially considering that the pH value of the developer is high.

The rinsing water may contain a fungicide (e.g., the compounds described in Horiguchi, *Bactericidal and Fungicidal Chemistry*, and those described in JP-A-62-115154), a rinsing promoter (e.g., sulfites), and a chelating agent.

The developed and fixed photographic material of the present invention is rinsed and then dried. Rinsing is effected for the purpose of nearly complete removal of the silver salts dissolved out of the photographic material by fixation, preferably at a temperature of about from 20° C. to 50° C. for a period of from 10 seconds to 3 minutes. Drying is effected at a temperature of about from 40° C. to 100° C. The drying time may be varied in accordance with the ambient condition, and is generally about from 5 seconds to 3 minutes and 30 seconds.

A roller conveyance type automatic developing machine which may be used for processing the photographic material of the present invention is described in U.S. Pat. Nos. 3,025,779 and 3,545,971. The machine is simply referred to as a roller conveyance processor herein. The roller conveyance processor is composed of four steps of development, fixation, rinsing and drying. Although not excluding any other steps (e.g., stopping step), the method of processing the photographic material of the present invention preferably comprises these four steps. The photographic material is preferably conveyed through the automatic developing machine at a speed of 1000 mm/min or more.

The amount of the replenisher (water or stabilizing solution) to the rinsing step is 1200 ml/m$^2$ or less (including 0 ml/m$^2$).

When the amount of the replenisher is 0 (zero), the rinsing step is of the stagnant rinsing system type. For reducing the amount of replenisher to the rinsing step, a known multistage countercurrent rinsing system (for example, two-stage or three-stage system) may be used.

Various problems which tend to occur when the amount of the replenisher to the rinsing step is reduced, can be overcome and solved by a combination of the various techniques described below.

Namely, a microbicide may be added to the rinsing bath or stabilizing bath, including, for example, the isothiazoline compounds described in R. T. Kreiman, *J. Image, Tech.*, Vol. 10, No. 6, 242 (1984); the isothiazoline compounds described in *Research Disclosure* (R.D.), Vol. 205, No. 20526 (May 1981); the isothiazoline compounds described in *ibid.*, Vol. 228, No. 22845 (April 1983); and the compounds described in JP-A-61-115154 and JP-A-62-209532. In addition, the bath may also contain other various compounds described in H. Horiguchi, *Bactericidal and Fungicidal Chemistry* (published by Kyoritsu Publishing Co., 1982), *Handbook for Bactericidal and Fungicidal Technology* (edited by Bactericidal and Fungicidal Society of Japan and published by Hakuhodo Publishing Co., 1986), L. E. West, *Water Quality Criteria*, Photo Sci. & Eng., Vol. 8, No. 6 (1965), and M. W. Beach, *Microbiological Growths in Motion Picture Processing*, SMPE Journal, Vol. 85 (1976), R. O. Deegan, Photo Processing Wash Water Biocides, J. Imaging Tech., Vol. 10, No. 6 (1984).

Where rinsing of the processed photographic material of the present invention is effected with a small amount of rinsing water, a squeeze roller or a cross-over rack rinsing tank is preferably used as described in JP-A-63-18350 and JP-A-62-287252.

A part or all of the overflow liquid from the rinsing bath or stabilization bath treated to suppress microbial proliferation, which overflow is generated by replenishment of water (or stabilizing solution) in processing the photographic material of the present invention, may be circulated to the previous fixing bath in the manner described in JP-A-60-235133 and JP-A-63-129343. To prevent mottles in the processed photographic material due to adhesion of water scum often caused by rinsing with a reduced amount of rinsing water and/or for prevention of transfer of processing components adhered to a squeeze roller, if used, to the processed photographic material, a water-soluble surfactant or a defoaming agent may be added to the rinsing bath or stabilization bath.

For prevention of staining of the processed photographic material due to dyes eluted from the photographic material during processing of the same, a dye adsorbing agent as described in JP-A-63-163456 may be added to the rinsing bath.

The photographic material of the present invention is preferably rapidly processed with an automatic developing machine in a total processing time of from 15 seconds to 60 seconds (dry to dry time), to effectively display the effect of the present invention.

In the rapid development of the photographic material of the present invention with such a rapid-processing automatic developing machine, the temperature and the time for development and fixation are each about from 25° C. to 50° C. and 25 seconds or less, preferably about from 30° C. to 40° C. and from 4 seconds to 15 seconds.

The developed and fixed photographic material of the present invention is rinsed or stabilized. In the rinsing step, a countercurrent two-stage or three-stage rinsing system may be employed to conserve the amount of water used therein. Where rinsing is effected with a small amount of water, a squeeze roller is preferably provided in the rinsing tank. A part or all of the overflow liquid from the stabilization bath may be circulated to the previous fixing bath in the manner described in JP-A-60-235133. In this manner, the amount of the waste from the stabilization process is advantageously reduced.

The developed, fixed and rinsed photographic material of the present invention is dried, via a squeeze roller. Drying is effected at a temperature of from 40° C. to 80° C. for a period of from 4 seconds to 30 seconds.

The total processing time for processing the photographic material of the present invention is the total time from insertion of the top of the film material to be processed into the inlet of an automatic developing machine to emergence of the top of the processed material from the outlet of the drying means, via the developer tank, the cross-over area, the fixation tank, the cross-over area, the rinsing tank, the cross-over area and the drying area.

Since the amount of gelatin used as a binder, in the emulsion layer and the protective layer of the silver halide photographic material of the present invention, may be reduced without adversely affecting the pressure mark resistance of the photographic material, rapid processing of the material may be effected in a total period of time of from 15 to 60 seconds without lowering the developing rate, fixation rate and drying rate.

The present invention is explained in greater detail by way of the following examples, which, however, are not intended to restrict the scope of the present invention.

EXAMPLE 1

1. Preparation of Silver Halide Emulsion (A):

40 g of gelatin were dissolved in one liter of water in a container previously heated to 53° C., to which were added 5 g of sodium chloride, 0.4 g of potassium bromide and 60 mg of compound (1):

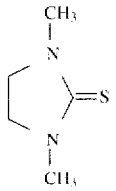

(1)

Next, 1000 ml of an aqueous solution containing 200 g of silver nitrate and 1080 ml of an aqueous solution containing potassium hexachloroiridate(III) in a molar ratio of iridium to silver of $1\times10^{-7}$ and containing 21 g of sodium chloride and 100 g of potassium bromide were added to the container by a double jet method to prepare cubic mono-dispersed silver chlorobromide grains having a mean grain size of 0.35 μm. After the emulsion was de-salted, 40 g of gelatin was added thereto. The emulsion was then adjusted to a pH of 6.0 and a pAg of 8.5. 2.5 mg of sodium thiosulfate and 4 mg of chloroauric acid were added thereto, and the emulsion was subjected to chemical sensitization at 60° C. 0.2 g of 4-hydroxy-6-methyl-1,3,3a,7-tetrazaindene was added thereto, which was then rapidly cooled for solidification (Emulsion (A)).

In the same manner as in preparation of Emulsion (A), cubic mono-dispersed silver chlorobromide grains having a mean grain size of 0.35 μm were prepared. After the emulsion was de-salted, 40 g of gelatin were added thereto. The emulsion was then adjusted to a pH of 6.0 and a pAg of 8.5. 2 mg of N,N-dimethylselenourea and 4 mg of chloroauric acid were added to the emulsion for chemical sensitization at 60° C. 0.2 g of 4-hydroxy-6-methyl-1,3,3a,7-tetrazaindene were added thereto, which was then rapidly cooled for solidification (Emulsion (B)).

Emulsion (C) was prepared in the same manner as Emulsion (C), except that 1 mg of N,N-dimethylselenourea and 1.5 mg of sodium thiosulfate were used in place of the 2.5 mg of sodium thiosulfate.

2. Preparation of Emulsion Coating Liquid:

850 g of each emulsion prepared above were weighed and placed in a container previously heated to 40° C. To this, the following additives were added to obtain an emulsion coating solution.

Composition of Emulsion Coating Solution

| | |
|---|---|
| a. Emulsion | 850 g |
| b. Spectral Sensitizing Dye [2] | $1.2\times10^{-4}$ mol |
| c. Super-Sensitizing Agent [3] | $0.8\times10^{-3}$ mol |
| d. Storability Improving Agent [4] | $1\times10^{-3}$ mol |
| e. Polyacrylamide (molecular weight: 40,000) | 7.5 g |
| f. Trimethylolpropane | 1.6 g |
| g. Sodium Polystyrenesulfonate | 2.4 g |
| h. Latex of Poly(ethyl acrylate/methacrylic acid) | 16 g |
| i. N,N'-Ethylenebis-(vinylsulfonacetamide) | 1.2 g |
| j. Compound [5] | 0.06 g |

The compounds used above are as follows:

Spectral Sensitizing Dye [2]:

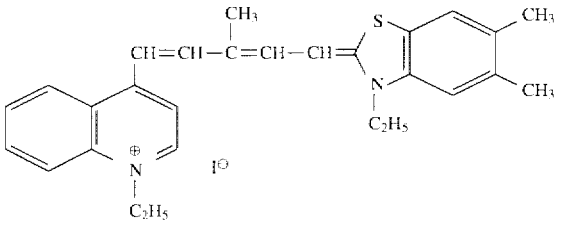

Super-Sensitizing Agent [3]:

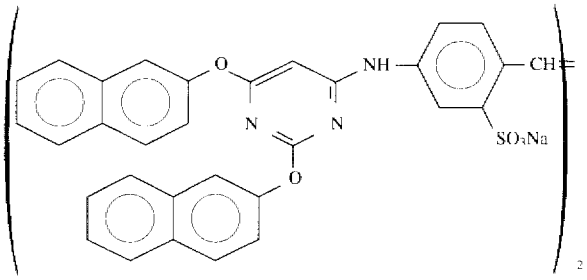

Storability Improving Agent [4]:

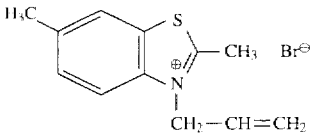

Compound [5]:

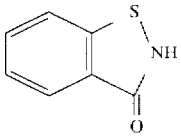

3. Preparation of Coating Solution of Surface-protective Layer for Emulsion Layer:

The following components were added to a container previously heated to 40° C., to prepare a coating solution.

Composition of Coating Solution of Surface-protective Layer for Emulsion Layer

| | |
|---|---|
| a. Gelatin | 100 g |
| b. Polyacrylamide (molecular weight: 40,000) | 10 g |
| c. Sodium Polystyrenesulfonate (molecular weight: 600,000) | 0.6 g |
| d. N,N'-ethylenebis-(vinylsulfonacetamide) | 1.5 g |
| e. Fine Grains of Polymethyl Methacrylate (mean grain size: 2.0 μm) | 2.2 g |
| f. Sodium t-octylphenoxyethoxyethanesulfonate | 1.2 g |
| g. $C_{16}H_{33}O—(CH_2CH_2O)_{10}—H$ | 2.7 g |
| h. Sodium Polyacrylate | 4 g |
| i. $C_8F_{17}SO_3K$ | 70 mg |
| j. $C_8F_{17}SO_2N(C_3H_7)(CH_2CH_2O)_4(CH_2)_4—SO_3Na$ | 70 mg |
| k. NaOH (1N) | 4 ml |
| l. Methanol | 60 ml |

4. Preparation of Backing Layer Coating Solution:

The following components were added to a container previously heated up to 40° C., to prepare a backing layer coating solution.

Composition of Backing Layer Coating Solution

| | |
|---|---|
| a. Gelatin | 80 g |
| b. Dye [6] | 3.1 g |
| c. Sodium Polystyrenesulfonate | 0.6 g |
| d. Poly(ethyl acrylate/methacrylic acid) Latex | 15 g |
| f. N,N'-ethylenebis-(vinylsulfonacetamide) | 4.3 g |

Compounds used above are as follows:

Dye [6]:

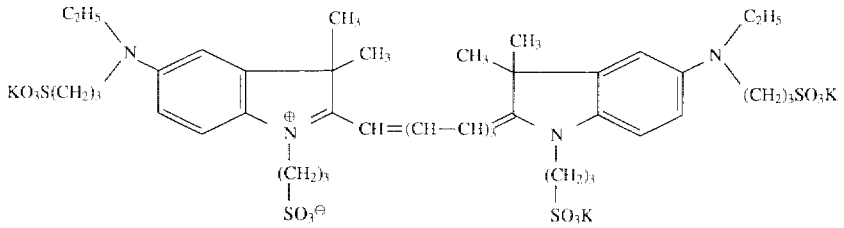

5. Preparation of Coating Solution of Surface-protective Layer for Backing Layer:

The following components were added to a container previously heated up to 40° C. to prepare a coating solution.

Composition of Coating Solution of Surface-protective Layer for Backing Layer

| | |
|---|---|
| a. Gelatin | 80 g |
| b. Sodium Polystyrenesulfonate | 0.3 g |
| c. N,N'-ethylenebis-(vinylsulfonacetamide) | 1.7 g |
| d. Fine Grains of Polymethyl Methacrylate (mean grain size: 4.0 μm) | 4 g |
| e. Sodium T-octylphenoxyethoxyethanesulfonate | 3.6 g |
| f. NaOH (1N) | 6 ml |
| g. Sodium Polyacrylate | 2 g |
| h. $C_{16}H_{33}O-(CH_2CH_2O)_{10}-H$ | 3.6 g |
| i. $C_8F_{17}SO_3K$ | 50 mg |
| j. $C_8F_{17}SO_2N(C_3H_7)(CH_2CH_2O)_4(CH_2)_4-SO_3Na$ | 50 mg |
| k. Methanol | 130 ml |

6. Formation of Coated Samples:

The above described backing layer coating solution was coated on one surface of a polyethylene terephthalate support along with the surface-protective coating solution for the backing layer. The total amount of the coated gelatin was 3 g/m$^2$. Next, the above described emulsion layer coating solution was coated on the other surface of the support along with the surface-protective layer coating solution. The coated Ag amount was 2.5 g/m$^2$ and the gelatin coated amount in the surface-protective layer was 1 g/m$^2$ (Coated Sample 1-1).

Sample 1-2 was prepared in the same manner as Sample 1-1, except that Emulsion (B) was used in place of Emulsion (A). Sample 1-3 was also prepared in the same manner, except that Emulsion (C) was used in place of Emulsion (A).

7. Method of Sensitometry:

The thus formed Samples 1-1 to 1-3 were subjected to sensitometry by the method described below, whereupon the sensitivity and fog of each sample was measured.

Namely, Samples 1-1 to 1-3 were stored under conditions of 25° C. and 60% RH for 7 days and then subjected to scanning exposure with a semiconductor laser of 780 nm for $10^{-7}$ second at room temperature. The thus exposed samples were then processed with the following Developer [1] and Fixer [1]. The development was effected in two stages comprising 7 seconds and 15 seconds. The sensitivity at initiation of first development and the final sensitivity were compared with one other for the respective samples.

The sensitivity value was represented by a reciprocal of the amount of exposure providing D=1.0, as a relative value.

The results obtained are shown in Table 1 below. Composition of Developer [1]:

| | |
|---|---|
| Potassium Hydroxide | 29 g |
| Sodium Sulfite | 31 g |
| Potassium Sulfite | 44 g |
| Ethylenetriaminetetraacetic Acid | 1.7 g |
| Boric Acid | 1 g |
| Hydroquinone | 30 g |
| Diethylene Glycol | 29 g |
| 1-Phenyl-3-pyrazolidone | 1.5 g |
| Glutaraldehyde | 4.9 g |
| 5-Methylbenzotriazole | 60 mg |
| 5-Nitroindazole | 0.25 g |
| Potassium Bromide | 7.9 g |
| Acetic Acid | 18 g |
| Compound [7] | 0.3 g |
| Compound [8] | 0.2 g |
| Compound [9] | 0.12 g |
| Water to make | 1000 ml |
| pH | 10.3 |

The compounds used above are as follows:

Compound [7]:

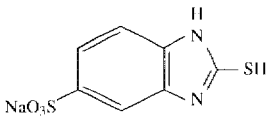

-continued

Compound [8]:

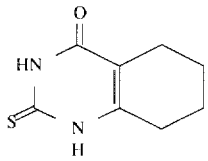

Compound [9]:

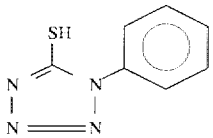

Composition of Fixer [I]:

| | |
|---|---|
| Ammonium Thiosulfate | 140 g |
| Sodium Sulfite | 15 g |
| Disodium Ethylenediaminetetraacetate Dihydrate | 20 mg |
| Sodium Hydroxide | 7 g |
| Aluminium Sulfate | 10 g |
| Boric Acid | 10 g |
| Sulfuric Acid | 3.9 g |
| Acetic Acid | 15 g |
| Potassium Iodide | 0.5 g |
| Water to make | 1000 ml |
| pH | 4.30 |

Composition of Developer [II]

| | |
|---|---|
| Potassium Hydroxide | 24 g |
| Sodium Sulfite | 40 g |
| Potassium Sulfite | 50 g |
| Diethylenetriaminepentaacetic Acid | 2.4 g |
| Boric Acid | 10 g |
| Hydroquinone | 35 g |
| Diethylene Glycol | 11 g |
| 4-Hydroxymethyl-4-methyl-1-phenyl-3-pyrazolidone | 6 g |
| 5-Mehtylbenzotriazole | 60 mg |
| Potassium Bromide | 2 g |
| Acetic Acid | 1.8 g |
| Water to make | 1000 ml |
| pH | 10.5 |

Composition of Fixer [II]

| | |
|---|---|
| Ammonium Thiosulfate | 140 g |
| Sodium Sulfite | 15 g |
| Disodium Ethylenediaminetetra-acetate Dihydrate | 25 mg |
| Sodium Hydroxide | 6 g |
| Water to make | 1000 ml |
| pH | 5.10 |

TABLE 1

| | | Development Time 7" | | Development Time 15" | | |
|---|---|---|---|---|---|---|
| Sample | Emulsion | Fog | Sensitivity | Fog | Sensitivity | |
| 1-1 | A | 0.02 | 71 | 0.02 | 100 | comparative sample |
| 1-2 | B | 0.04 | 184 | 0.06 | 233 | sample of the invention |
| 1-3 | C | 0.02 | 140 | 0.03 | 176 | sample of the invention |

EXAMPLE 2

Samples 1-1 to 1-3 were subjected to sensitometry in the same manner as in Example 1, except that the samples were processed with the following Developer [II] and Fixer [II], whereupon the sensitivity of each sample was measured. The results obtained are shown in Table 2 below.

TABLE 2

| | | Development Time 7" | | Development Time 15" | | |
|---|---|---|---|---|---|---|
| Sample | Emulsion | Fog | Sensitivity | Fog | Sensitivity | |
| 1-1 | A | 0.02 | 91 | 0.02 | 110 | comparative sample |
| 1-2 | B | 0.05 | 213 | 0.08 | 244 | sample of the invention |
| 1-3 | C | 0.03 | 168 | 0.04 | 185 | sample of the invention |

EXAMPLE 3

1. Preparation of Silver Halide Emulsions (D) and (E):

32 g of gelatin were dissolved in one liter of water in a container previously heated to 53° C. to which were added 0.3 g of potassium bromide, 5 g of sodium chloride and 46 mg of compound (10):

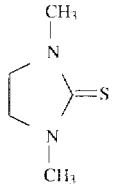

(10)

Next, 444 ml of an aqueous solution containing 80 g of silver nitrate and 452 ml of an aqueous solution containing 45 g of potassium bromide and 5.5 g of sodium chloride were added to the container by a double jet method over a period of about 20 minutes. Subsequently, 400 ml of an aqueous solution containing 80 g of silver nitrate and an aqueous solution containing 46.4 g of potassium bromide, 5.7 g of sodium chloride and potassium hexachloroiridate(III) ($1\times10^{-7}$ mol/mol of silver) were added thereto by a double jet method over a period of about 25 minutes to prepare cubic mono-dispersed silver chlorobromide grains having a mean grain size of 0.34 μm (as a diameter of the projected area). The fluctuation coefficient of the diameter of the projected area of the grains was 10%.

After the emulsion was de-salted, 62 g of gelatin and 1.75 g of phenoxyethanol were added thereto. The emulsion was adjusted to a pH of 6.5 and a pAg of 8.5.

Next, the emulsion was heated to 65° C. and 2 mg of sodium thiosulfate were added thereto. After 2 minutes, 5 mg of chloroauric acid was added thereto. After 80 minutes, 512 mg of 4-hydroxy-6-methyl-1,3,3a,7-tetrazaindene were added thereto. Then, the mixture was rapidly cooled for solidification to obtain Emulsion D.

Emulsion E was prepared in the same manner as Emulsion D, except that $3\times10^{-6}$ mol of N,N-dimethylselenourea and 1 mg of sodium thiosulfate were added in place of the 1 mg of sodium thiosulfate.

2. Preparation of Emulsion Coating Solution:

The following compounds were added to each emulsion prepared above, the amounts indicated below each being per mol of silver halide.

| | |
|---|---|
| a. Spectral Sensitizing Dye (11) | 138 mg |
| b. Spectral Sensitizing Dye (12) | 42.5 mg |
| c. Polyacrylamide (molecular weight: 40,000) | 8.54 g |
| d. Trimethylolpropane | 1.2 g |
| e. Sodium Polystyrenesulfonate (mean molecular weight: 600,000) | 0.46 g |
| f. Latex of Poly(ethyl acrylate/methacrylic acid) | 32.8 g |
| g. 1,2-Bis(vinylsulfonylacetamido)ethane | 2 g |

The compounds used above are as follows:

Spectral Sensitizing Dye (11):

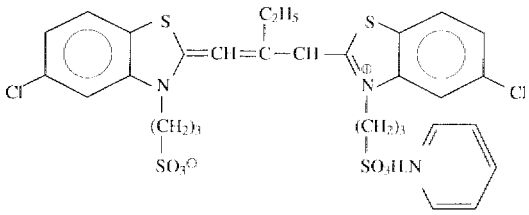

Spectral Sensitizing Dye (12):

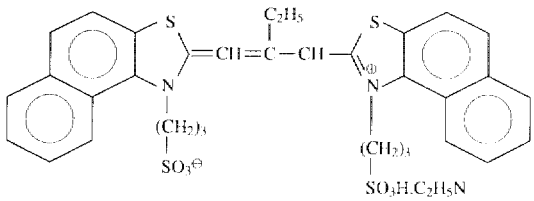

3. Preparation of Coating Solution of Surface-protective Layer for Emulsion Layer:

The following compounds were added to a container previously heated to 40° C. to prepare a coating solution.

| | |
|---|---|
| a. Gelatin | 100 g |
| b. Polyacrylamide (molecular weight: 40,000) | 12.3 g |
| c. Sodium Polystyrenesulfonate (molecular weight: 600,000) | 0.6 g |
| d. Fine Grains of Polymethyl Methacrylate (mean grain size: 2.5 μm) | 2.7 g |
| e. Sodium Polyacrylate | 3.7 g |
| f. Sodium T-octylphenoxyethoxy-ethanesulfonate | 1.5 g |
| g. $C_{16}H_{33}O-(CH_2CH_2O)_{10}-H$ | 3.3 g |
| h. $C_8F_{17}SO_3K$ | 84 mg |
| i. $C_8F_{17}SO_2N(C_3H_7)(CH_2CH_2O)_4(CH_2)_4-SO_3Na$ | 84 mg |
| j. NaOH | 0.2 g |
| k. Methanol | 78 cc |
| l. 1,2-Bis(vinylsulfonylacetamido)ethane 2.3 wt.% to the total gelatin amount in the emulsion layer and the surface-protective layer | |
| m. Compound (13) | 52 mg |

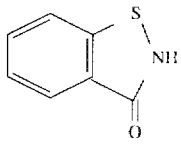

4. Preparation of Backing Layer Coating Solution:

The following compounds were added to a container previously heated to 40° C. to prepare a backing layer coating solution.

| | |
|---|---|
| a. Gelatin | 100 g |
| b. Dye (14) | 2.39 g |

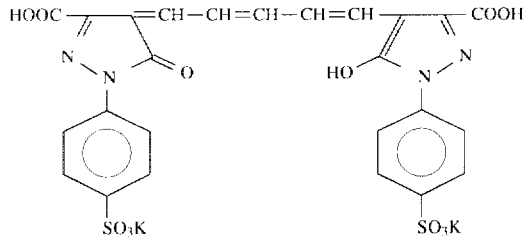

| | |
|---|---|
| c. Sodium Polystyrenesulfonate | 1.1 g |
| d. Phosphoric Acid | 0.55 g |
| f. Poly(ethyl acrylate/methacrylic acid) Latex | 2.9 g |
| g. Compound (13) | 46 mg |

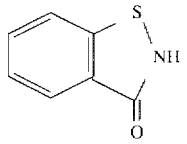

| | |
|---|---|
| h. Oil Dispersion of Dye described in JP-A-61-285445 Dye (15): | 246 mg (as dye) |

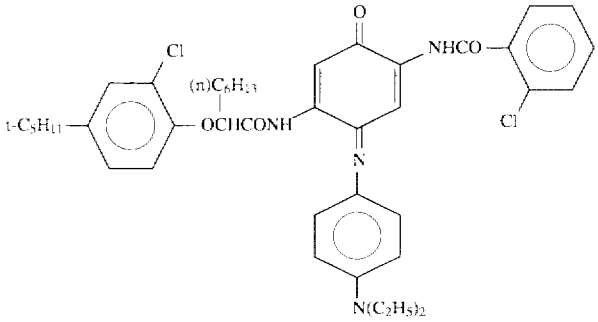

| | |
|---|---|
| i. Oligomer Surfactant Dispersion of Dye described in JP-A-62-275639 Dye (16): | 46 mg (as dye) |

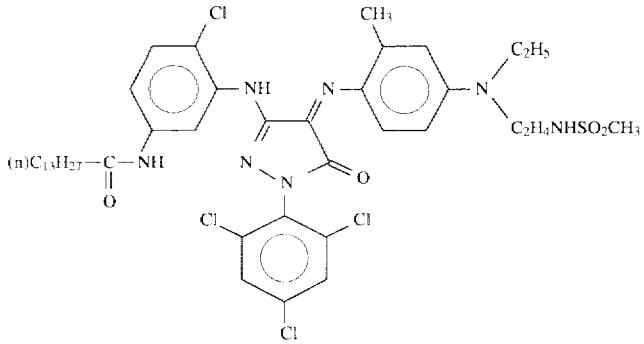

5. Preparation of Coating Solution of Surface-protective Layer for Backing Layer:

The following compounds were added to a container previously heated to 40° C. to prepare a coating solution.

| | |
|---|---|
| a. Gelatin | 100 g |
| b. Sodium Polystyrenesulfonate | 0.3 g |
| c. Fine Grains of Polymethyl Methacrylate (mean grain size: 3.5 μm) | 4.3 g |
| d. Sodium T-octylphenoxyethoxyethanesulfonate | 1.8 g |
| e. Sodium Polyacrylate | 1.7 g |
| f. $C_{16}H_{33}O-(CH_2CH_2O)_{10}-H$ | 3.6 g |
| g. $C_8F_{17}SO_3K$ | 268 mg |
| h. $C_8F_{17}SO_2N(C_3H_7)(CH_2CH_2O)_4(CH_2)_4-SO_3Na$ | 45 mg |

-continued

| | |
|---|---|
| i. NaOH | 0.3 g |
| j. Methanol | 131 ml |
| k. 1,2-Bis(vinylsulfonylacetamido)ethane 2.2 wt. % to the total gelatin amount in the backing layer and the surface-protective layer | |
| m. Compound (13) | 45 mg |

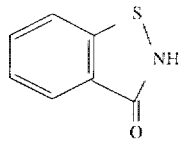

6. Formation of Coated Samples:

The above described backing layer coating solution was coated on one surface of a blue-colored polyethylene terephthalate support along with the surface-protective coating solution for the backing layer. The amount of gelatin in the backing layer was 2.69 g/m$^2$ and that in the surface protective layer was 1.13 g/m$^2$. Next, the above described emulsion layer coating solution was coated on the other surface of the support along with the surface-protecting layer coating solution. The coated Ag amount in the emulsion layer was 2.4 g/m$^2$, the coated gelatin amount in the emulsion layer was 1.85 g/m$^2$, and the coated gelatin amount in the surface protective layer was 1.2 g/m$^2$. Thus, coated samples 2-1 and 2-2 were prepared.

7. Method of Sensitometry:

The thus prepared samples were subjected to sensitometry by the method described below, whereupon the photographic sensitivity and fog of each sample was measured.

Precisely, the samples were stored under conditions of 25° C. and 60% RH for 7 days and then subjected to laser exposure with a 633 nm He-Ne layer exposing machine Model AC-1 (made by Fuji Photo Film Co., Ltd.). The samples were also exposed with an exposing machine Model FCR-7000 (made by Fuji Photo Film Co., Ltd.), the 780 nm semiconductor laser exposing means of which had been modified to have a 5 mW-678 nm semiconductor laser emitting means of AlGaInP made by the Nippon Electric Co., Ltd.

The exposed samples were then developed with a processor Model FPM-9000 (made by Fuji Photo Film Co., Ltd.), using the developer RD-7 at 35° C. and the fixer Fuji-F (of the Fuji Photo Film Co., Ltd.). The dry-to-dry processing time was 45 seconds.

The sensitivity value was represented by a reciprocal of the amount of exposure to obtain D=1.0, as a relative value.

The results obtained are shown in Table 3 below.

TABLE 3

| Sample | Emulsion | Fog | Relative sensitivity | |
|---|---|---|---|---|
| 2-1 | D | 0.02 | 100 | comparative sample |
| 2-2 | E | 0.02 | 186 | sample of the invention |

While the invention has been described in detail and with reference to specific embodiments thereof, it will be apparent to one skilled in the art that various changes and modifications can be made therein without departing from the spirit and scope thereof.

What is claimed is:

1. A silver halide photographic material for laser exposure comprising a support having thereon at least one light-sensitive silver halide emulsion layer comprising a silver halide emulsion containing cubic silver chlorobromide grains having a silver chloride content of from 5 to 50 mol %, wherein the cubic silver chlorobromide grains have been prepared in the presence of an iridium metal dopant, and wherein the silver halide emulsion is spectrally sensitized with a spectral sensitizing dye selected from the group consisting of compounds represented by formulae (I), (II) and (III) and the silver halide emulsion is chemically sensitized with a selenium compound and a gold compound:

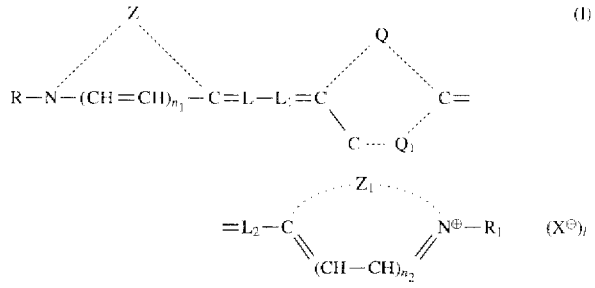

(I)

where Z and $Z_1$ each represent a non-metallic atomic group necessary for completing a 5-membered or 6-membered nitrogen-containing heterocyclic nucleus;

R and $R_1$ each represent an alkyl group or an aryl group;

Q and $Q_1$ together represent a non-metallic atomic group necessary for completing a 4-thiazolidinone, 5-thiazolidinone or 4-imidazolidinone nucleus;

L, $L_1$ and $L_2$ each represent a methine group;

$n_1$ and $n_2$ each represent 0 or 1;

X represents an anion; and

ι represents 0 or 1, and when the compound forms an internal salt, then ι is 0:

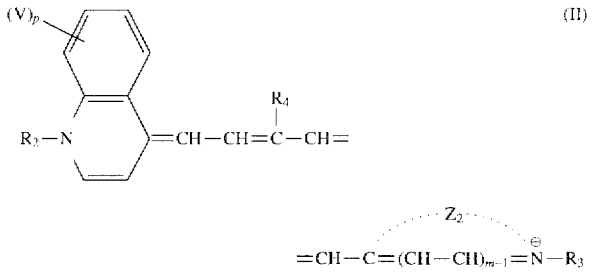

(II)

where $R_2$ and $R_3$ may be the same as or different from each other and each represent an alkyl group;

$R_4$ represents a hydrogen atom, an alkyl group having from 1 to 4 carbon atoms, an alkoxy group having from 1 to 4 carbon atoms, a phenyl group, a benzyl group or a phenethyl group;

V represents a hydrogen atom, an alkyl group having from 1 to 4 carbon atoms, an alkoxy group, or a halogen atom;

$Z_2$ represents a non-metallic atomic group necessary for completing a 5-membered or 6-membered nitrogen-containing hetero ring;

$X_1$ represents an acid anion; and m, p and q independently represent 1 or 2, provided that when the compound forms an internal salt, then q is 1:

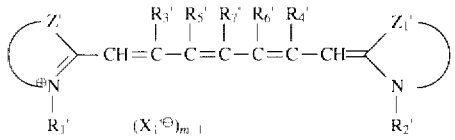

(III)

where $R_1'$ and $R_2'$ may be the same as or different from each other and each represent an alkyl group;

$R_3'$ and $R_4'$ independently represent a hydrogen atom, an alkyl group having from 1 to 4 carbon atoms, an alkoxy group having from 1 to 4 carbon atoms, a phenyl group, a benzyl group or a phenethyl group;

$R_5'$ and $R_6'$ each represent a hydrogen atom, or $R_5'$ and $R_6'$ are bonded to each other to form a divalent alkylene group;

$R_7'$ represents a hydrogen atom, an alkyl group having from 1 to 4 carbon atoms, an alkoxy group having from 1 to 4 carbon atoms, a phenyl group, a benzyl group, or —$NW_1'(W_2')$ in which $W_1'$ and $W_2'$ independently represent an alkyl group or an aryl group or $W_1'$ and $W_2'$ may be bonded to each other to form a 5-membered or 6-membered nitrogen-containing hetero ring;

$R_3'$ and $R_7'$, or $R_4'$ and $R_7'$ may be bonded to each other to form a divalent alkylene group;

$Z'$ and $Z_1'$ independently represent a non-metallic atomic group necessary for forming a 5-membered or 6-membered nitrogen-containing hetero ring;

$X_1'$ represents an acid anion; and m' represents 1 or 2, provided that when the dye forms an internal salt, then m' is 1;

wherein the silver halide emulsion of the at least one light-sensitive silver halide emulsion layer is coated in an amount of silver of 2.8 g/m$^2$ or less based on one surface side of the support, and further the same surface side of the support is coated with gelatin in a total amount of gelatin of 4 g/m$^2$ or less.

2. The silver halide photographic material as in claim 1, wherein the selenium compound is used for the chemical sensitization in an amount of $1\times10^{-8}$ mol or more per mol of the silver halide.

3. The silver halide photographic material as in claim 1, wherein the gold compound is used for the chemical sensitization in an amount of from $1\times10^{-7}$ to $5\times10^{-4}$ mol per mol of the silver halide.

4. The silver halide photographic material as in claim 1, wherein the spectral-sensitizing dye represented by formulae (I) to (III) are used for the spectral sensitization in an amount of $1\times10^{-7}$ to $1\times10^{-2}$ mol per mol of the silver halide.

5. The silver halide photographic material as in claim 1, wherein the silver chlorobromide grains have a mean grain size of 0.7 μm or less.

6. The silver halide photographic material as in claim 1, wherein the silver chlorobromide grains have a silver chloride content of from 5 to 30 mol %.

7. The silver halide photographic material as in claim 1, wherein the spectral sensitizing dyes represented by formulae (I) to (III) are used for the spectral sensitization in an amount of $1\times10^{-6}$ to $5\times10^{-3}$ mol per mol of the silver halide.

8. The silver halide photographic material as in claim 1, wherein the iridium metal dopant is potassium hexachloroiridate (III).

9. The silver halide photographic material as in claim 1, wherein the silver halide emulsion is super-sensitized with a compound represented by formula (VII)

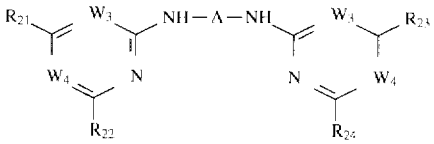

(VII)

wherein —A— represents a divalent aromatic group optionally comprising an —$SO_3M$ group wherein M represents a hydrogen atom or a cation for making the compound soluble in water;

$R_{21}$, $R_{22}$, $R_{23}$ and $R_{24}$ each represent a hydrogen atom, a hydroxyl group, a lower alkyl group, an alkoxy group, an aryloxy group, a halogen atom, a heterocyclic group, an alkylthio group, a heterocyclylthio group, an arylthio group, an amino group, an alkylamino group, an arylamino group, a heterocyclyl amino group, an aralkylamino group, an aryl group or a mercapto group, wherein $R_{21}$, $R_{22}$, $R_{23}$ and $R_{24}$ may be the same or different from each other, provided that if —A— does not comprise an —$SO_3M$ group wherein M is as defined above, then at least one of $R_{21}$, $R_{22}$, $R_{23}$ and $R_{24}$ must have a sulfo group; and $W_3$ and $W_4$ each represent —CH= or —N=, provided that at least one of $W_3$ and $W_4$ is —N=.

10. A silver halide photographic material comprising a support having thereon at least one light-sensitive silver halide emulsion layer comprising a silver halide emulsion containing cubic silver chlorobromide grains having a silver chloride content of 5 30 mol %, wherein the silver halide emulsion is spectrally sensitized with a spectral sensitizing dye selected from the group consisting of compounds represented by formulae (I), (II) and (III) and the silver halide emulsion is chemically sensitized with a selenium compound and a gold compound:

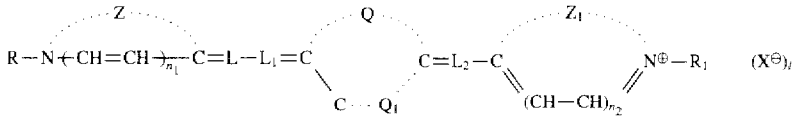

(I)

where Z and $Z_1$ each represent a non-metallic atomic group necessary for completing a 5-membered or 6-membered nitrogen-containing heterocyclic nucleus;

R and $R_1$ each represent an alkyl group, or an aryl group;

Q and $Q_1$ together represent a non-metallic atomic group necessary for completing a 4-thiazolidinone, 5-thiazolidinone or 4-imidazolidinone nucleus;

L, $L_1$ and $L_2$ each represent a methine group;

$n_1$ and $n_2$ each represent 0 or 1;

X represents an anion; and

ι represents 0 or 1, and when the compound forms an internal salt, then ι is 0;

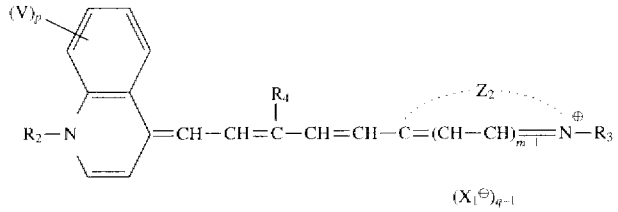

(II)

where $R_2$ and $R_3$ may be same as or different from each other and each represent an alkyl group;

$R_4$ represents a hydrogen atom, an alkyl group having from 1 to 4 carbon atoms, an alkoxy group having from 1 to 4 carbon atoms, a phenyl group, a benzyl group or a phenethyl group;

V represents a hydrogen atom, an alkyl group having from 1 to 4 carbon atoms, an alkoxy group, or a halogen atom;

$Z_2$ represents a non-metallic atomic group necessary for completing a 5-membered or 6-membered nitrogen-containing hetero ring;

$X_1$ represents an acid anion; and m, p and q independently represent 1 or 2, provided that when the compound forms an internal salt, then q is 1:

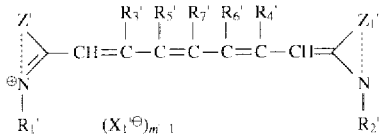

(III)

where $R_1'$ and $R_2'$ may be same as or different from each other and each represent an alkyl group;

$R_3'$ and $R_4'$ independently represent a hydrogen atom, an alkyl group having from 1 to 4 carbon atoms, an alkoxy group having from 1 to 4 carbon atoms, a phenyl group, a benzyl group or a phenethyl group;

$R_5'$ and $R_6'$ each represents a hydrogen atom, or $R_5'$ and $R_6'$ are bonded to each other to form a divalent alkylene group;

$R_7'$ represents a hydrogen atom, an alkyl group having from 1 to 4 carbon atoms, an alkoxy group having from 1 to 4 carbon atoms, a phenyl group, a benzyl group or $—NW_1'(W_2')$ in which $W_1'$ and $W_2'$ independently represent an alkyl group or an aryl group or $W_1'$ and $W_2'$ may be bonded to each other to form a 5-membered or 6-membered nitrogen-containing hetero ring;

$R_3'$ and $R_7'$, or $R_4'$ and $R_7'$ may be bonded to each other to form a divalent alkylene group;

Z' and $Z_1'$ independently represent a non-metallic atomic group necessary for forming a 5-membered or 6-membered nitrogen-containing hetero ring;

$X_1'$ represents an acid anion; and m' represents 1 or 2, provided that when the dye forms an internal salt, then m' is 1.

* * * * *